US010011005B2

(12) United States Patent
Shute et al.

(10) Patent No.: US 10,011,005 B2
(45) Date of Patent: Jul. 3, 2018

(54) BAR CLAMP

(71) Applicant: Irwin Industrial Tool Company, Huntersville, NC (US)

(72) Inventors: Jillian Shute, Hunterville, NC (US); Norman John LeBlanc, Davidson, NC (US); Brian Butler, Kalamazoo, MI (US); Daniel K. Self, Huntersville, NC (US); Douglas Johnson, Belmont, NC (US); Web Shaffer, Weatogue, CT (US); Catherine Kasubowski Leonard, Charlotte, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 534 days.

(21) Appl. No.: 14/630,884

(22) Filed: Feb. 25, 2015

(65) Prior Publication Data

US 2015/0246431 A1 Sep. 3, 2015

Related U.S. Application Data

(60) Provisional application No. 61/946,238, filed on Feb. 28, 2014.

(51) Int. Cl.

| | |
|---|---|
| ***B25B 3/00*** | (2006.01) |
| ***B25B 5/16*** | (2006.01) |
| ***B25B 5/06*** | (2006.01) |
| ***B27L 7/00*** | (2006.01) |
| ***B25B 5/00*** | (2006.01) |
| ***B25B 5/08*** | (2006.01) |

(Continued)

(52) U.S. Cl.

CPC ..... *B25B 5/163* (2013.01); *B25B 5/003* (2013.01); *B25B 5/006* (2013.01); *B25B 5/068* (2013.01); *B25B 5/085* (2013.01); *B25B 5/102* (2013.01); *B25B 5/142* (2013.01); *B25B 5/16* (2013.01); *B27L 7/005* (2013.01)

(58) Field of Classification Search

CPC .... B25B 1/00; B25B 5/00; B25B 5/02; B25B 5/127; B25B 5/102

See application file for complete search history.

(56) References Cited

U.S. PATENT DOCUMENTS 6,530,565 B1 * 3/2003 Simpson ..... B25B 5/166 269/147
6,957,808 B2 * 10/2005 Varzino ..... B25B 1/08 269/170

(Continued)

OTHER PUBLICATIONS

American Tool, Quick-Grip Specialty Clamps, pp. 2-6-2-7, Clamp Products Catalog, 2001.

*Primary Examiner* — Lee Wilson
(74) *Attorney, Agent, or Firm* — Eversheds Sutherland (US) LLP

(57) ABSTRACT

A bar clamp has a slide bar supporting a movable jaw assembly. The slide bar is supported in a fixed jaw assembly. The fixed jaw assembly includes a drive mechanism for moving the slide bar relative to the fixed jaw assembly. Mechanisms for expanding the capacity of the bar clamp including the use of straps and two slide bars. Specialized jaws are provided where the jaws may be removable from the jaw assemblies. Additional clamping jaws are provided in addition to the movable and fixed jaw assemblies for varying the clamping force applied to a workpiece.

13 Claims, 35 Drawing Sheets

(51) Int. Cl.
*B25B 5/10* (2006.01)
*B25B 5/14* (2006.01)

(56) References Cited

U.S. PATENT DOCUMENTS

| | | | | |
|---|---|---|---|---|
| 7,398,966 | B2 * | 7/2008 | Hubbard | B25B 5/068 269/155 |
| 8,382,047 | B1 * | 2/2013 | Hildebrand | F16L 3/003 248/316.4 |
| 2013/0134642 | A1 * | 5/2013 | Chen | B25B 5/006 269/6 |
| 2015/0246431 | A1 * | 9/2015 | Shute | B25B 5/163 144/195.4 |

* cited by examiner

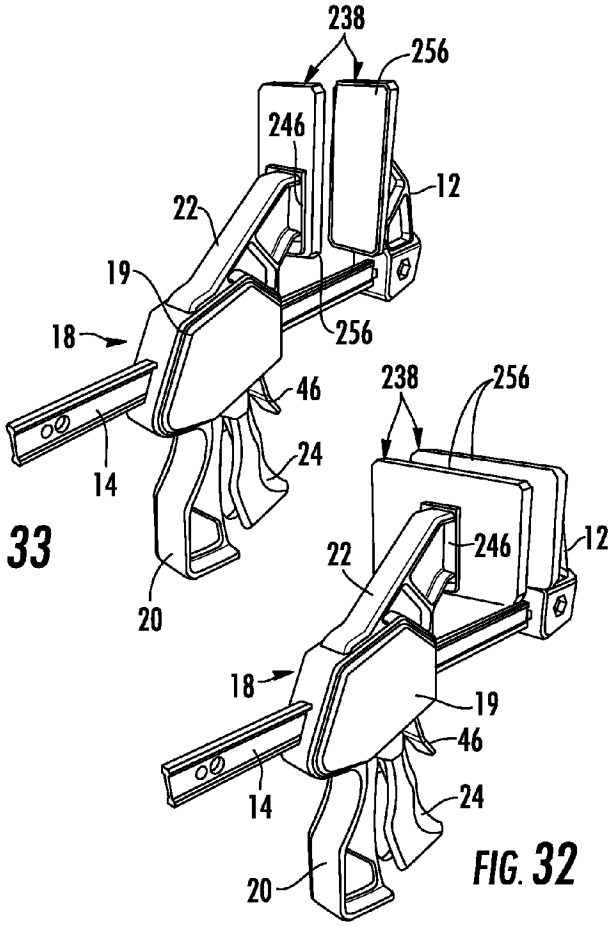
FIG. 33
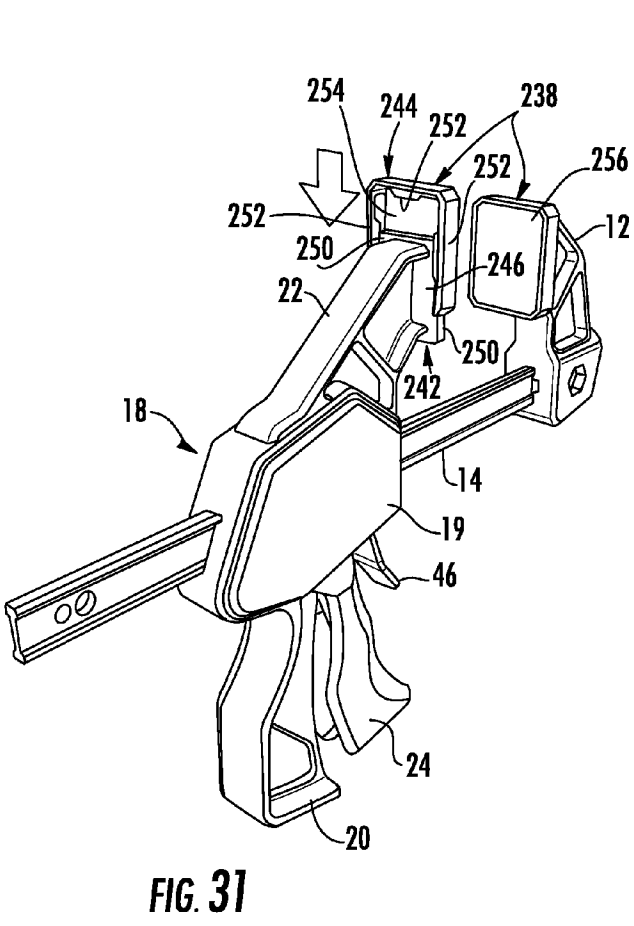
FIG. 31
FIG. 32

BAR CLAMP

This application claims benefit of priority under 35 U.S.C. § 119(e) to the filing date of U.S. Provisional Application No. 61/946,238, as filed on Feb. 28, 2014, which is incorporated herein by reference in its entirety.

BACKGROUND

Bar clamps typically comprise a housing that supports a fixed jaw, a bar that carries a movable jaw and that is supported by the housing/fixed jaw for reciprocating movement such that the movable jaw can be moved towards and away from the fixed jaw. The housing further supports a drive and brake mechanism for controlling the movement of the bar. The drive mechanism typically comprises a handle extending from the housing/fixed jaw and an actuator lever or trigger mounted for pivoting movement. The actuator lever is operatively connected to the bar to incrementally advance the bar every time the actuator lever is pulled. In a preferred arrangement of the bar clamp the actuator lever is formed as part of a "pistol grip" with the handle and is located just in front of the handle such that the bar clamp can be easily and comfortably operated with one hand. Typically the jaws comprise relatively small rectangular pads that may be made of an elastomeric material that apply the clamping force to the article. A brake mechanism is provided to hold the bar in position relative to the housing/fixed jaw and to prevent the jaws from spreading from the clamping position. A brake release lever is provided to release the brake mechanism to allow the jaws to be spread.

SUMMARY

Embodiments of a bar clamp are described where the bar clamp comprises a slide bar supporting a movable jaw assembly. The slide bar is supported in a fixed jaw assembly. The fixed jaw assembly includes a drive mechanism for moving the slide bar relative to the fixed jaw assembly. In some embodiments the slide bar comprises a first slide bar connected to a second slide bar by a releasable connector that expands the capacity of the bar clamp. In some embodiments an edge clamp is mounted on the slide bar between the fixed jaw assembly and the movable jaw assembly comprising a movable jaw movable in a second direction transverse to the direction of movement of the slide bar. In some embodiments an accessory mounting system is provided for releasably mounting a plurality of accessories to the bar clamp. The mounting system may comprise a rail and a channel repositionable on the rail. A locking mechanism may fix the position of the accessory relative to the rail. In some embodiments removable jaw attachments are mounted on the jaw assemblies. The jaw attachments may comprise deck board engagement members, a wood splitter, and corner jaws. In some embodiments a strap may be attached to the movable jaw assembly and the fixed jaw assembly to increase the capacity of the clamp.

BRIEF DESCRIPTION OF THE DRAWINGS

FIG. 31 is a perspective view of another embodiment of a bar clamp of the invention with a first jaw attachment.

FIG. 32 is a perspective view of the bar clamp of FIG. 31 with a second jaw attachment.

FIG. 33 is a perspective view of the bar clamp of FIG. 31 with a third jaw attachment.

DETAILED DESCRIPTION

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Relative terms such as "below" or "above" or "upper" or "lower" or "horizontal" or "vertical" or "top" or "bottom" may be used herein to describe a relationship of one element, component or region to another element, component or region as illustrated in the figures. It will be understood that these terms are intended to encompass different orientations of the device in addition to the orientation depicted in the figures.

Figure 8:
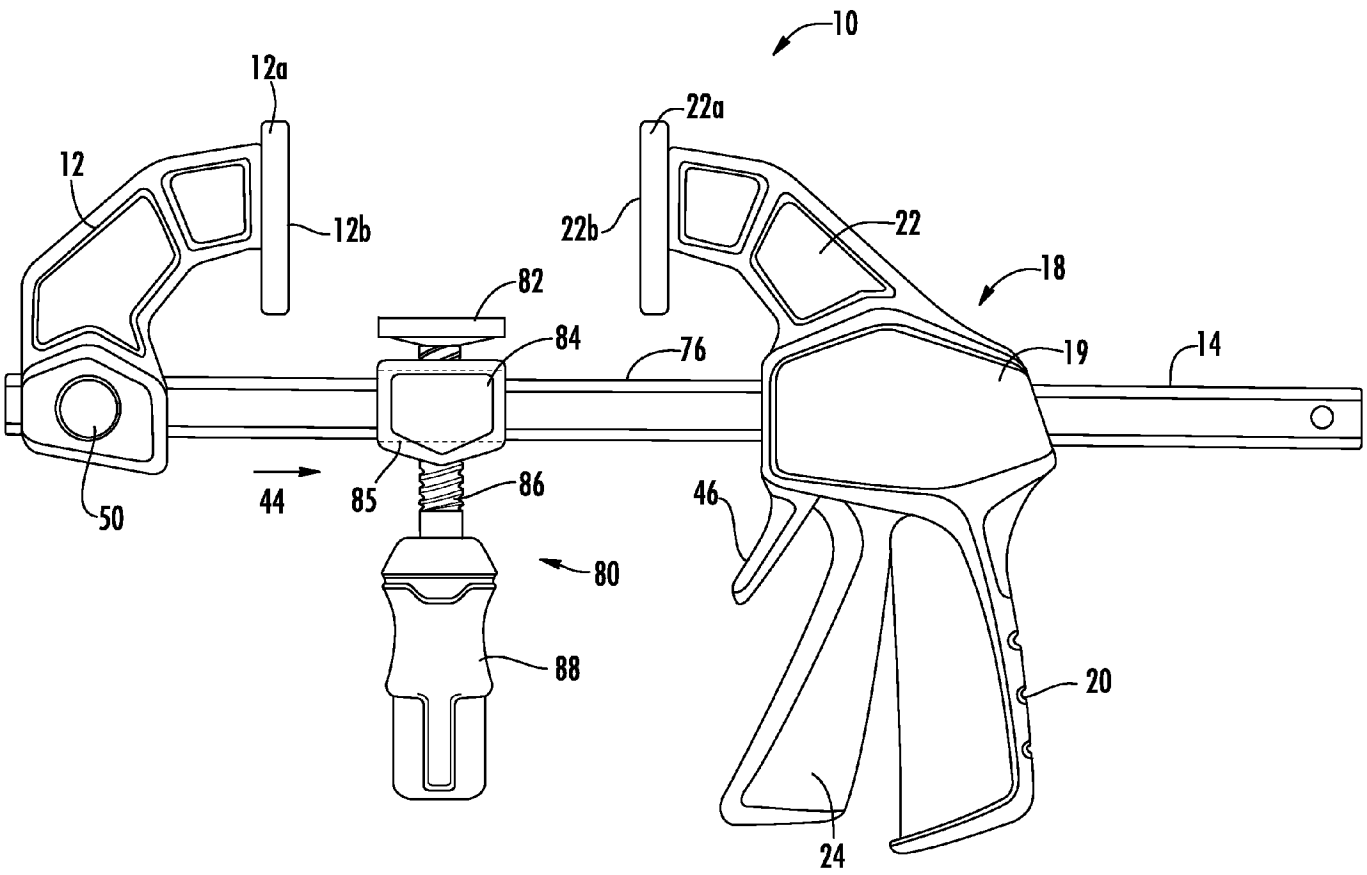
FIG. 8 is a side view of another embodiment of a bar clamp of the invention.

Referring to the figures various embodiments of bar clamps are shown. The basic structure and operation of the bar clamp will be described that is generally applicable to all of the disclosed embodiments. Referring, for example, to FIG. 8, bar clamp 10 includes a movable jaw assembly 12 connected to a slide bar 14. The slide bar is slidably supported in a slot which passes through a handle/grip assembly 18. The handle/grip assembly 18 includes a body 19 through which the slide bar 14 passes, a handgrip 20 attached to the body 19 on one side of the slide bar, and a fixed jaw assembly 22 attached to the body 19 on the other side of the slide bar. A trigger or actuator lever 24 is pivotably mounted to the body 19. The movable jaw assembly 12 includes a jaw 12*a* having a jaw face 12*b* that opposes a jaw face 22*b* on the jaw 22*a* of the fixed jaw assembly 22 such that the jaws can be moved toward one another to clamp a workpiece.

The actuator lever 24 is squeezed toward the handgrip 20 to incrementally advance the slide bar 14 with its attached movable jaw assembly 12 toward the fixed jaw assembly 22. When the actuator lever 24 is squeezed by a user's hand (not shown) toward the handgrip 20, the actuator lever 24 pivots about a pivot point in body 19. Movement of the actuator lever 24 causes a driving lever to bind against the surface of the slide bar 14. Further motion of the actuator lever 24 causes the slide bar 14 to translate in the direction of the arrow 44. Due to the binding interference between the driving lever and bar 14, the bar 14 and its connected movable jaw assembly 12 are advanced toward the fixed jaw assembly 22. When the actuator lever 24 is depressed, a spring in body 19 is compressed such that upon release of the actuator lever 24, the spring causes the actuator lever 24 and driving lever to return to the original position. Additional strokes may be applied to the actuator lever 24 of any magnitude until the jaw assemblies 12, 22 come together, or a workpiece is firmly gripped between them. Different bar clamps may have different driving mechanisms than that specifically described including variable force drive mechanisms, variable length of travel drive mechanisms and the like.

A braking lever 46 is provided where one end of the braking lever 46 is pivotably captured in the body 19 such that the braking lever 46 may bind on the slide bar 14 and may be pivoted out of engagement with the slide bar 14 by a user. A spring biases the free end of the braking lever 46 away from the actuator lever 24. The biased position of the braking lever 46 is limited by the binding interference between the braking lever 46 with the slide bar 14. In the standby position. the braking lever 46 is engaged with the slide bar 14 such that if a force is applied to the movable jaw assembly 12 in the direction indicated by the arrow 44, the slide bar 14 is free to move. Because the braking lever 46 is free to pivot against the bias of the spring when force is applied on the movable jaw assembly 12 in the direction of the arrow 44, the braking lever 46 presents no obstacle to this motion of the slide bar and the movable jaw assembly 12 may be advanced continuously toward the fixed jaw assembly 22. However, if a force is applied to the movable jaw assembly 12 in the direction opposite to the direction indicated by the arrow 44, the braking lever 46 binds against the slide bar 14 and it is not possible, without further action, to move the movable jaw assembly 12 away from the fixed jaw assembly 22. Depression of the braking lever 46 releases the binding engagement between the braking lever 46 and the slide bar such that the slide bar 14 and movable jaw assembly 12 may be moved away from the fixed jaw assembly 22. With the braking lever 46 depressed the slide bar 14 is free to slide in either direction.

While one such drive mechanism for a bar clamp has been described it is to be appreciated that the drive mechanism for a bar clamp may vary from that described and that numerous different types of drive mechanisms for a bar clamp are known. Suitable example drive mechanisms for a bar clamp are disclosed in U.S. Pat. Nos. 4,926,722, 5,009,134, 5,022,137 and 6,367,787, which are incorporated by reference herein in their entirety.

Figures 1A, 1B:
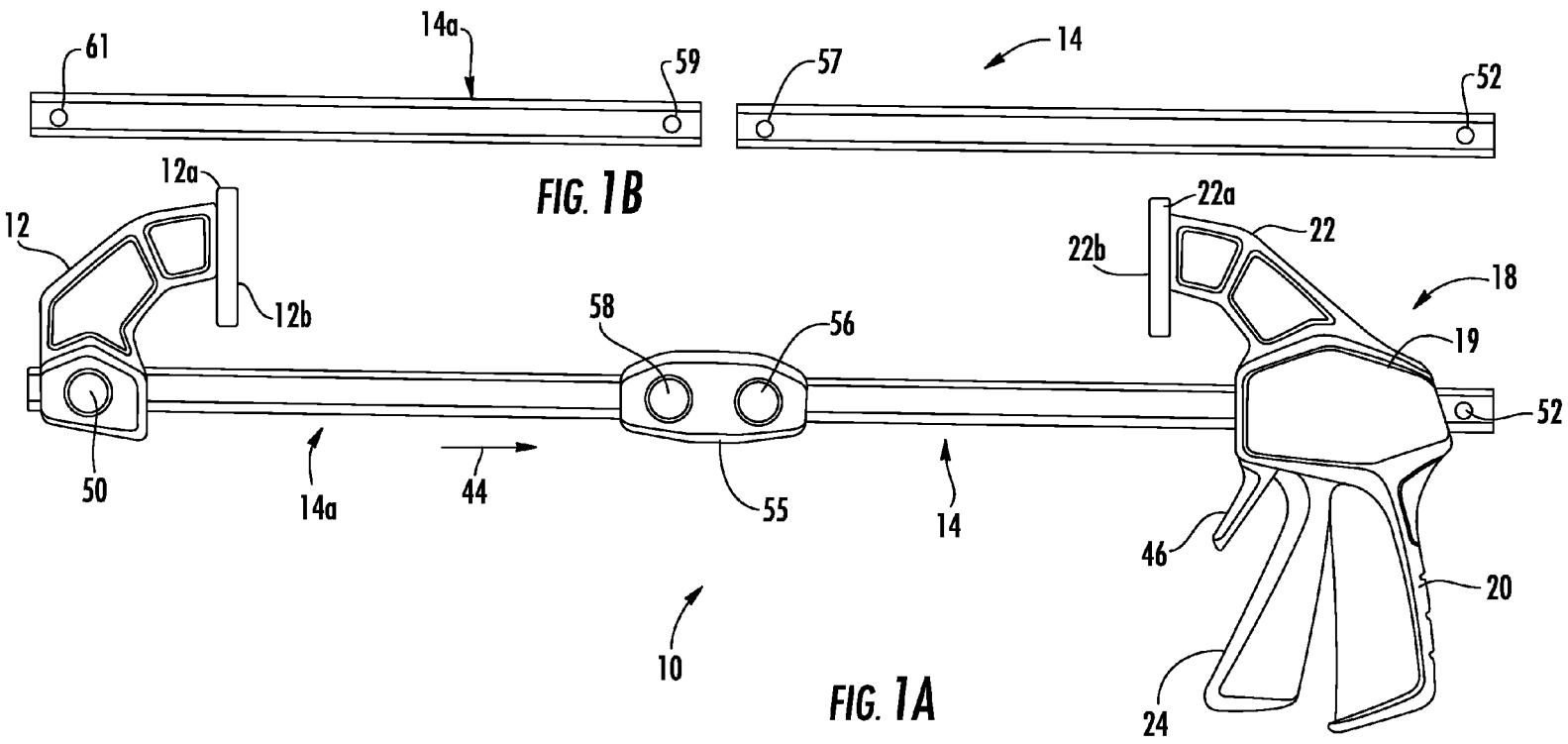
FIG. 1A is a side view of a first embodiment of a bar clamp of the invention.
FIG. 1B is a side view showing the two slide bars used in the bar clamp of FIG. 1.
Figure 2:
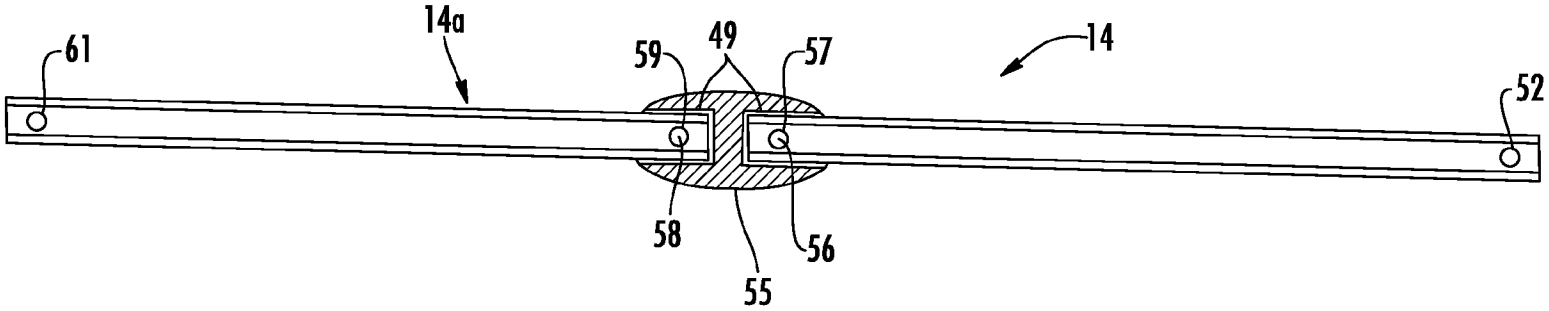
FIG. 2 is a vertical section view of the connection of FIG. 1A.
Figure 3:
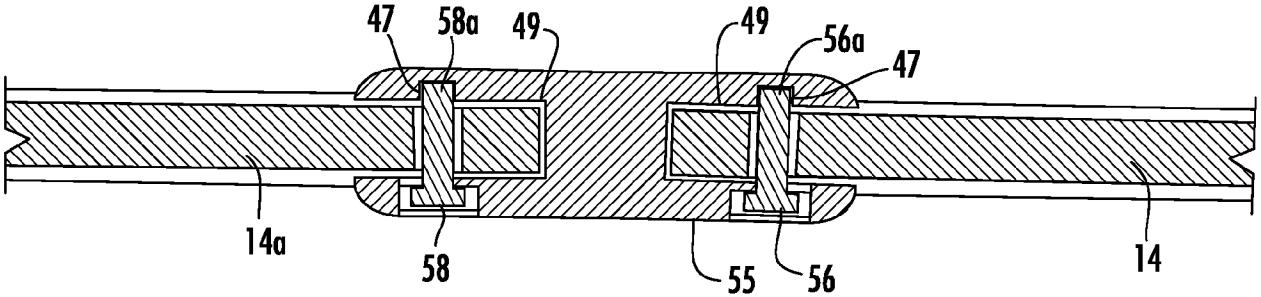
FIG. 3 is a horizontal section view of the connection of FIG. 1A.

Referring to FIGS. 1A-6, in one embodiment of a slide bar 14 apertures 52, 57 are formed at either end of the bar that may be engaged by a laterally movable connector 50 on the movable jaw assembly 12 such that the movable jaw assembly 12 may be mounted to either end of the bar 14. When the movable jaw assembly 12 is configured as shown in FIG. 1 the bar clamp functions as a clamping tool. When the movable jaw assembly 12 is mounted to aperture 52 the bar clamp may function as a spreading tool.

A connector 55 is provided that may engage the apertures at the end of the slide bar. The connector 55 may engage a first aperture 57 at the end of a first slide bar 14 and a second aperture 59 at the end of a second slide bar 14*a* such that the bars 14 and 14*a* may be releasably connected together. The movable jaw 12 is mounted at the opposite end of the second slide bar 14*a* at aperture 61 to form an extended size bar clamp. The two slide bars 14 and 14*a* may be of the same length or they may be of different lengths. The connector 55 of the invention uses the apertures that are typically formed at the end of a slide bar to connect two or more slide bars together. The connector 55 and second slide bar 14*a* may be used to increase the clamping distance between the jaw assemblies 12, 22. Two or more connectors 55 may be used to connect three or more slide bars if desired. The clamp allows larger size articles to be gripped between the jaws 12*a* and 22*a* when two or more slide bars 14, 14*a* are used while allowing the bar clamp to be used with a single slide bar for smaller articles.

The connector 55 may comprise slots 49 for receiving the ends of the first and second slide bars 14, 14*a*. A first laterally movable pin 56 may engage the aperture 57 on the first slide bar 14 and a second laterally movable pin 58 may engage the aperture 59 on the second slide bar 14*a*. The slots 49 in the connector 55 hold the slide bars 14, 14*a* in-line with one another and the engagement of the pins 56, 58 with the apertures 57, 59 prevent the bars 14, 14*a* from separating when a clamping force is applied to an article. The movable pins 56, 58 may be secured in various ways. In one embodiment the distal ends 56*a*, 58*a* of the pins may include screwthreads that engage mating threaded holes 47 in the connector 55. The pins 56, 58 may be biased laterally by a spring (not shown) to disengage the pins from the slide bars 14, 14*a* when the screws are unthreaded from the connector 55. In other embodiments the pins 56, 58 may be secured by a ball/detent arrangement, friction fit, snap-fit connector or the like. In some embodiments the distal end of the pins 56, 58 may extend through the connector and be secured by a separate fastener such as a nut engaging screwthreads on the pins, a cotter pin 43 (FIG. 6) or the like. The pins 56, 58 may be released to remove the connector 55 and second slide bar 14*a*. When the second slide bar 14*a* is removed the movable jaw assembly 12 may be removed from second slide bar 14*a* and reattached to the end of the first slide bar 14 at either aperture 57 or aperture 52. Because the connector 55 uses the apertures commonly found on bar clamps for securing the movable jaw assembly 12, the connector may be sold separately and a user may remove the slide bar from a second bar clamp and add it to a first bar clamp. The connector 55 may also be sold with a second slide bar 14*a* as a kit where the second slide bar may be provided in various lengths.

Figure 4:
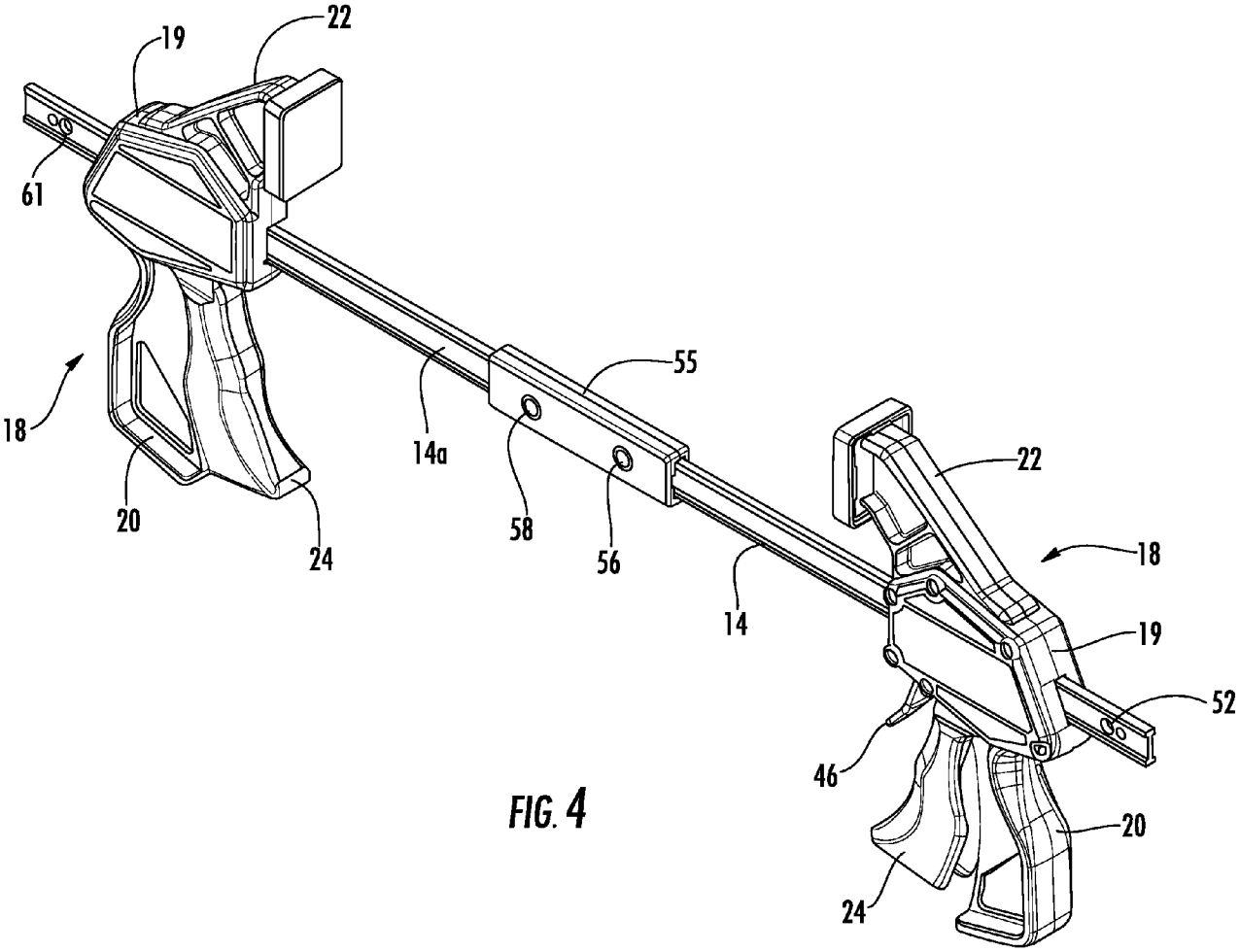
FIG. 4 is a perspective view of an alternate embodiment of the bar clamp of FIG. 1A.
Figure 5:
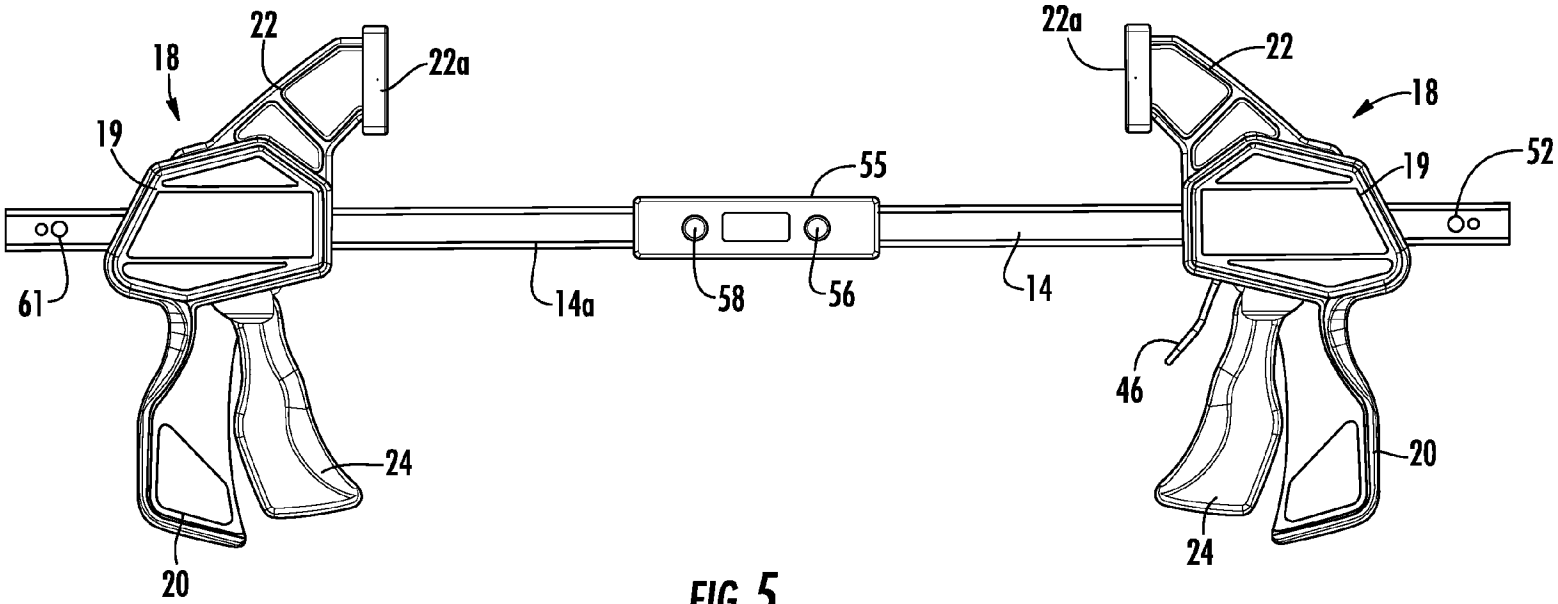
FIG. 5 is a side view of the bar clamp of FIG. 4.
Figure 6:
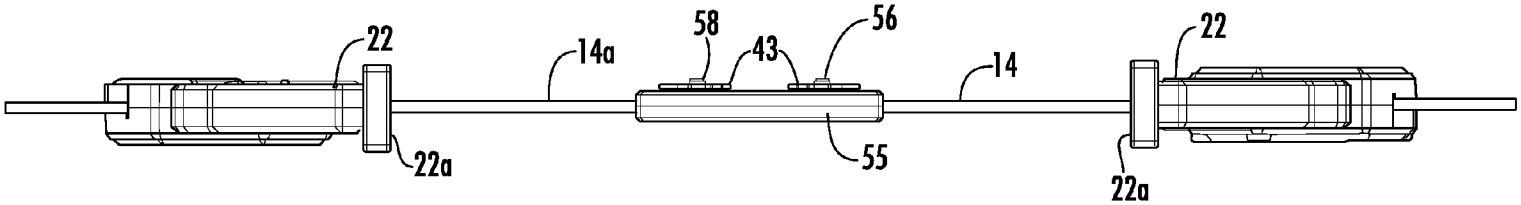
FIG. 6 is a top view of the bar clamp of FIG. 4.

In the embodiment shown in FIGS. 1-6 two slide bars 14, 14*a* are connected by connector 55 as previously described. However, in the embodiment of FIGS. 4-6 the second slide bar 14*a* is mounted in a second handle/grip assembly 18 and fixed jaw assembly 22 rather than supporting a movable jaw assembly 12 as shown in the embodiment of FIG. 1A. In this arrangement the jaw assemblies 22 may be advanced toward one another using either handle/grip assembly 18. In the embodiment of FIGS. 4-6 only one of the handle/grip assemblies 18 may include a brake release lever if desired.

Figure 7:
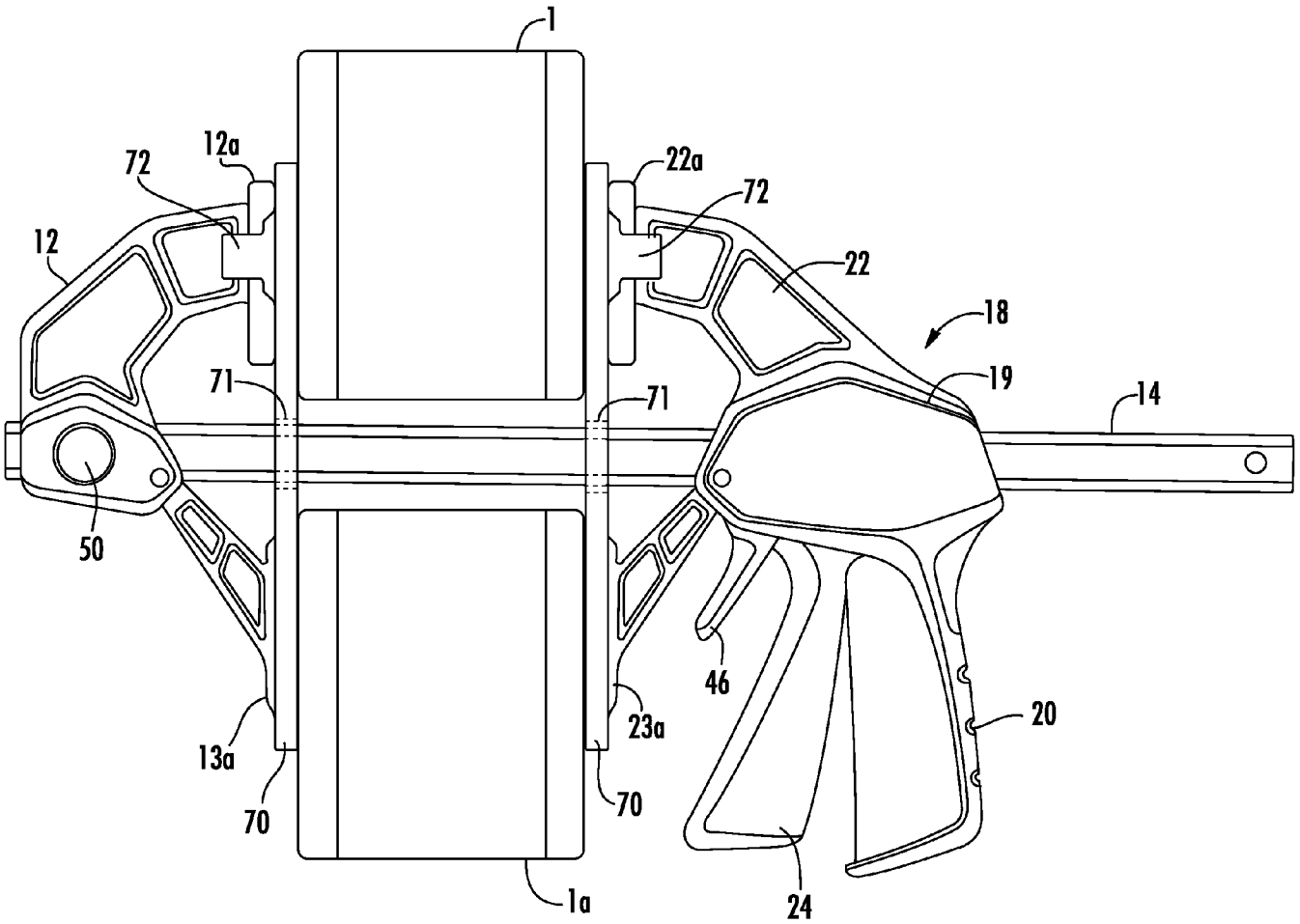
FIG. 7 is a side view of another embodiment of a bar clamp of the invention with clamping workpieces.

FIG. 7 shows a bar clamp where each of the movable jaw assembly 12 and the fixed jaw assembly 22 are provided with two jaws 12*a*, 13*a* and 22*a*, 23*a* respectively. The jaws on each jaw assembly 12 and 22 are spaced from one another such that two work pieces 1 and 1*a* may be clamped at the same time using the same clamping pressure. In the illustrated embodiment the opposing jaws 12*a* and 22*a* are positioned above the slide bar 14 and the opposing jaws 13*a* and 23*a* are positioned below the slide bar. In other embodiments the jaws may be positioned on opposite lateral sides of the slide bar. A common jaw face 70 may be provided that extends between the upper jaws 12*a*, and lower jaw 13*a* and between the upper jaw 22*a* and the lower jaw 23*a* such that both jaws apply force to the common jaw faces 70. The jaw faces 70 may comprise a relatively soft material such as an elastomer and the jaw faces 70 may be connected to one jaw at a connection 72 and may extend over, but not be connected to, the second jaw. In some embodiments the jaw face 70 may be connected to both jaws 12*a*, 13*a* and 22*a*, 23*a*. The jaw faces 70 may comprise an aperture 71 for receiving the slide bar 14 such that the slide bar may extend through the jaw faces and freely move relative to the jaw faces. In some embodiments each of jaws 12*a*, 13*a*, 22*a* and 23*a* may have separate jaw faces rather than the common jaw faces 70.

FIG. 8 shows a bar clamp with an edge clamp 80. The edge clamp 80 may comprise a body 84 having a slot 85 that receives slide bar 14 such that the edge clamp 80 may be movably mounted on the slide bar 14. The edge clamp 80 may be repositioned along the length of the slide bar 14 between jaw assemblies 12 and 22. The edge clamp 80 comprises a movable jaw 82 that may be moved perpendicularly to the direction of movement of slide bar 14. In one embodiment the clamp 80 is a screw clamp where a screw 86 is threadably engaged with a threaded bore on body 84 such that rotation of handle 88 moves the jaw 82. The screw may be laterally offset from slide bar 14 such that the screw 86 and slide bar 14 do not interfere with one another. The movable jaw 82 may extend over the slide bar 14 such that a force may be applied to an article being clamped between jaws 12 and 22 along the center line of the slide bar. Other mechanisms for moving the clamp may be used. The edge clamp 80 is arranged such that jaw 82 may apply a clamping force to a workpiece that is substantially perpendicular to the clamping force applied by the jaws 12*a* and 22*a*. In this manner a lateral force may be applied to a workpiece 1 that is clamped between the jaws 12*a* and 22*a*. When the edge clamp 80 is engaged with a workpiece the clamping force exerted on the edge clamp will bind the edge clamp 80 against the slide bar 14 such that the edge clamp does not move relative to the slide bar.

Figure 9:
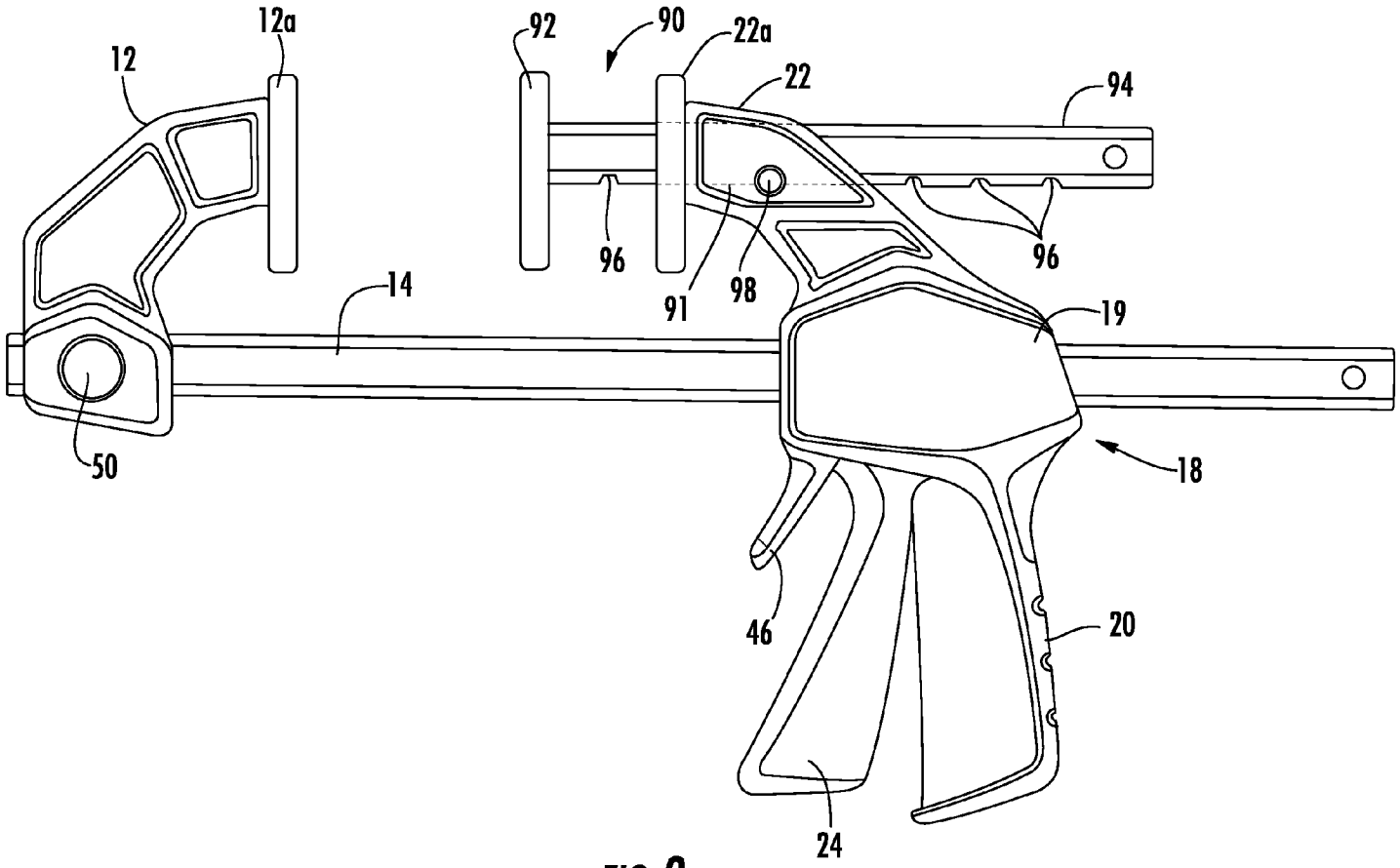
FIG. 9 is a side view of another embodiment of a bar clamp of the invention.

FIG. 9 shows a bar clamp having an adjustable depth jaw assembly 90. The adjustable depth jaw assembly 90 comprises a jaw 92 mounted on an elongated member 94 that is supported in a slot 91 formed in one of the movable jaw assembly 12 and/or the fixed jaw assembly 22. In the illustrated embodiment the jaw 92 is mounted in the fixed jaw assembly 22. The elongated member 94 is movable in the slot 91 relative to the jaw assembly 22 in a direction that is approximately parallel to the direction of movement of slide bar 14 such that the jaw 92 may be positioned at adjustable spacing from movable jaw assembly 12. The position of the elongated member 94 in jaw assembly 22 is fixed when a clamping pressure is exerted on the jaw 92 when a workpiece is clamped between the jaw 92 and the moveable jaw assembly 12. When pressure is applied to the jaw 92, the elongated member 94 is pivoted slightly about the engagement point between one of the notches 96 with a transverse locking surface 98 such as a pin in the slot 91 in the fixed jaw assembly 22. When the elongated member 94 pivots an upper edge of the member 94 is brought into binding engagement with a second surface of the slot 91. The binding engagement locks the elongated member 94 in position relative to the fixed jaw assembly 22. When pressure on the elongated member 94 is removed the adjustable depth jaw assembly 90 may be easily and freely moved relative to the fixed jaw assembly 22. The adjustable depth jaw assembly 90 allows the gross spacing between the opposing jaws to be quickly and easily set.

Figure 10:
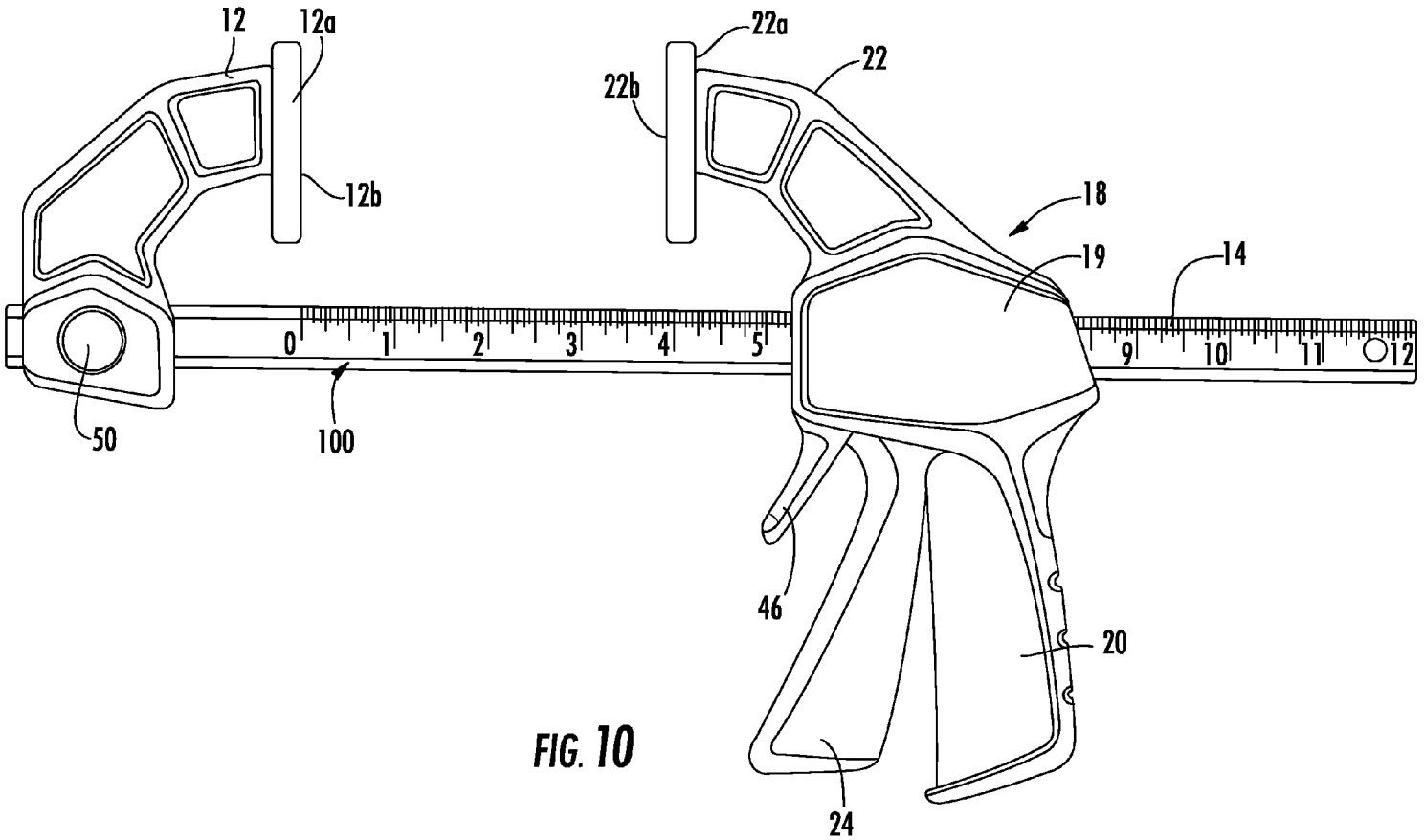
FIG. 10 is a side view of another embodiment of a bar clamp of the invention.

FIG. 10 shows a bar clamp where units of measurement 100 are provided on the slide bar 14. The units of measurement 100 may comprise length units and may be English, metric or other units. Moreover, one standard unit of measurement may be provided on one side of the slide bar 14 and a second unit of measurement may be provided on the opposite side of the slide bar 14. Alternatively, two different units of measurement may be applied to the same side of slide bar 14. Moreover, the units of measurement may be application specific. The units of measurement may be used to set the spacing between the jaw assemblies 22 and 12, to measure the workpiece between the jaws or for other uses. The units of measurement may be applied in any convenient manner such as paint, by application of a film or the units may be formed as part of the slide bar 14 such as by being stamped into the slide bar. In one embodiment the units of measurement begin in-line with the face 12*b* of the jaw 12*a* such that, for example, the zero point is located in the plane of the face 12*b*.

Figure 11:
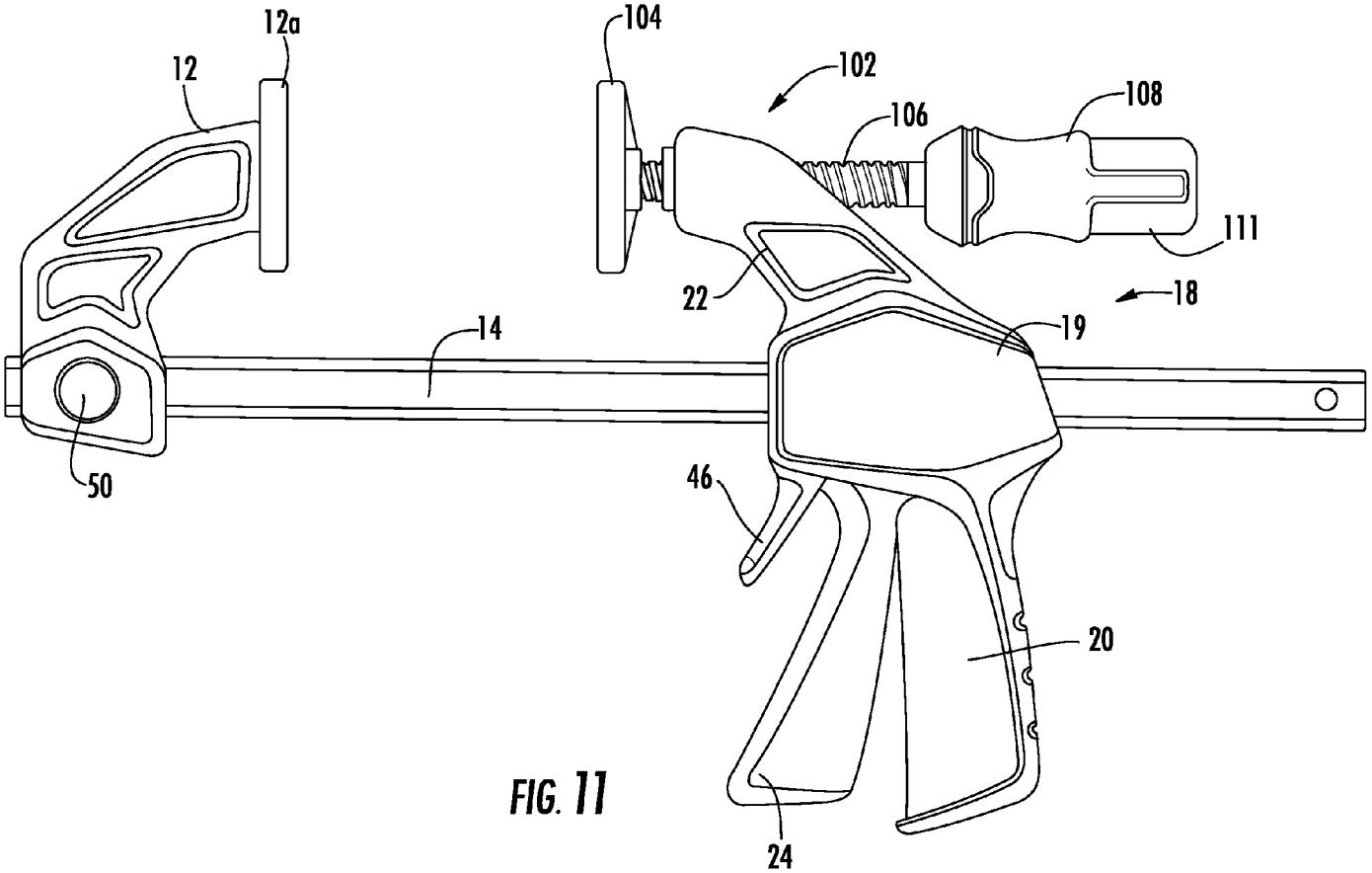
FIG. 11 is a side view of another embodiment of a bar clamp of the invention.

FIG. 11 shows a bar clamp having an adjustable pressure clamp assembly 102. The adjustable pressure clamp assembly 102 comprises a movable jaw 104 that may be moved parallel to the direction of movement of slide bar 14 and may be mounted on one of the movable jaw assembly 12 and/or the fixed jaw assembly 22. In the illustrated embodiment the clamp assembly 102 is mounted on the fixed jaw assembly 22. The clamp assembly 102 may comprise a screw clamp where a screw 106 is threadably engaged with a threaded bore on body 19 such that rotation of handle 108 moves the jaw 104 toward and away from jaw assembly 12. Other embodiments of a clamp may be used. The clamp assembly 102 is arranged such that the jaw 104 may apply an adjustable clamping force that is substantially parallel to the clamping force applied by the movement of the slide bar 14. The movable jaw assembly 12 may be moved toward the adjustable pressure clamp assembly 102 to clamp a workpiece between jaw 12*a* and jaw 104. The screw 106 may then be rotated to adjust the clamp pressure on the workpiece. In some embodiments the end of the handle 108 may have a tool engagement structure 111 such as female socket or a male square that may be engaged by a ratcheting torque wrench (not shown) or similar tool. The wrench may be used to apply a desired force on the workpiece.

Figure 12:
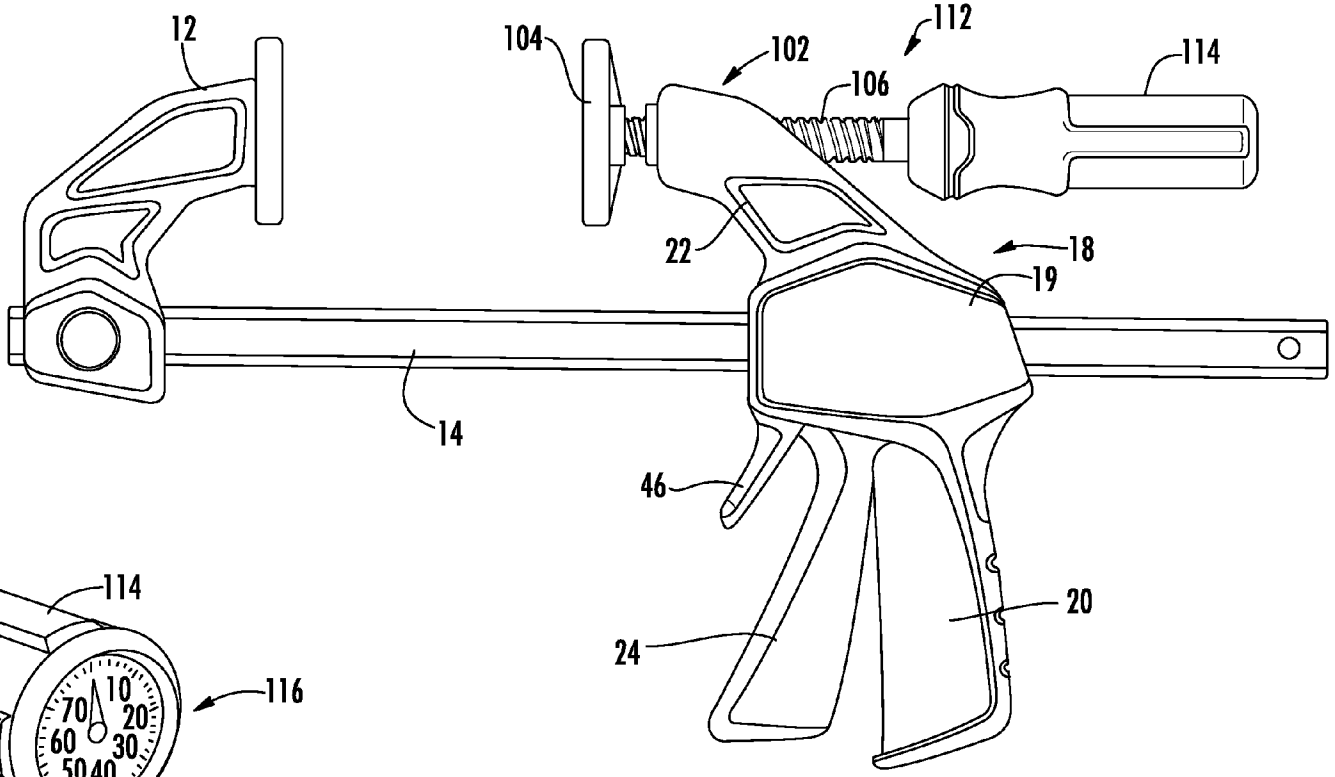
FIG. 12 is a side view of another embodiment of a bar clamp of the invention.
Figure 13:
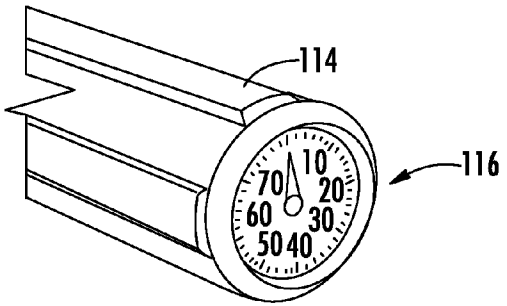
FIG. 13 is a detailed perspective view of the bar clamp of FIG. 12.

FIGS. 12 and 13 show a bar clamp having an adjustable pressure clamp assembly 112 similar to the adjustable pressure clamp assembly 102 of FIG. 11. Like reference numerals are used to identify like components previously described with respect to the embodiment of FIG. 11. A ratcheting function may be built into the handle 114 such that the separate ratchet wrench used with the embodiment of FIG. 11 may be eliminated. The handle 114 may comprise a torque gauge 116, FIG. 13, such that a user can determine and control the amount of force applied to the work piece by clamp assembly 112. The torque gauge 116 may provide a visual or audible signal when a preset load is reached.

Figure 14:
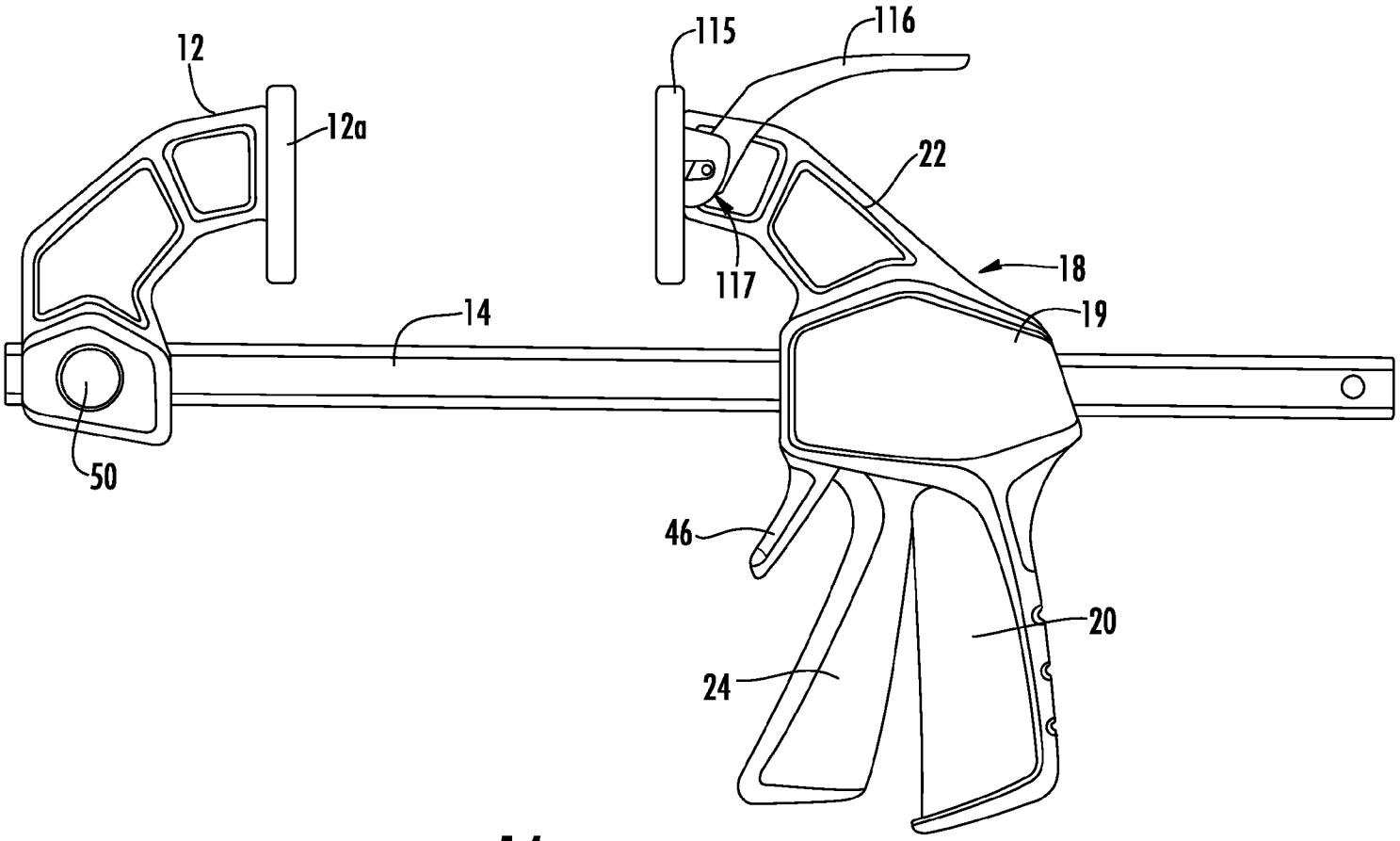
FIG. 14 is a side view of another embodiment of a bar clamp of the invention.

FIG. 14 shows a bar clamp having a lock down jaw 115. The lock down jaw 115 may be moved in a direction approximately parallel to the direction of movement of slide bar 14 and may be supported on one of the movable jaw assembly 12 and/or the fixed jaw assembly 22. In the illustrated embodiment, the lock down jaw is mounted on the fixed jaw assembly 22. The jaw 115 is arranged such that the jaw 115 may apply a clamping force that is substantially parallel to the clamping force applied by the movement of the slide bar 14. The movable jaw assembly 12 may be moved toward the lock down jaw 115 to clamp a workpiece between jaw 12*a* and jaw 115. The lever 116 may then be rotated to move the lock down jaw 115 toward the movable jaw 12*a* to apply a clamp pressure on the workpiece. The lever 116 may be connected to the jaw 115 by an over-center linkage 117 such that the pressure may be released only upon the release of the lever 116.

Figure 15:
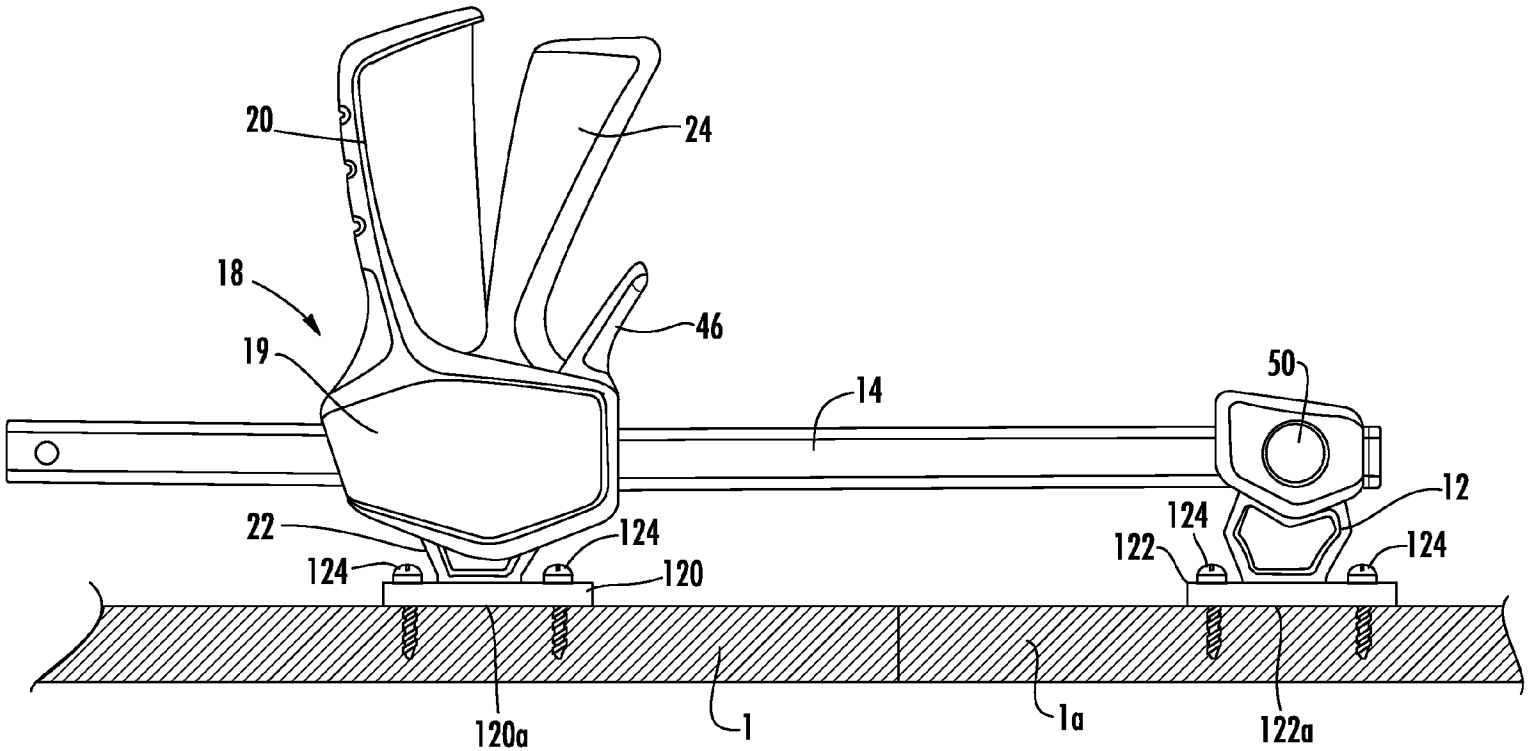
FIG. 15 is a side view of another embodiment of a bar clamp of the invention with clamping workpieces.

FIG. 15 shows a bar clamp where the opposing jaws 12*a* and 22*a* of the traditional bar clamp are replaced by mounting plates 120 and 122. The plates 120, 122 are oriented such that a mounting surface 120*a*, 122*a* of each of the plates 120, 122 is parallel to the direction of movement of slide bar 14. The mounting surfaces 120, 122 are coplanar and the plane of the surfaces is outside of the jaw assemblies 12 and 22. The mounting plates 120, 122 include apertures that receive screws 124 such that the plates 120, 122 may be secured to a face of the workpieces 1, 1*a*. The bar clamp operates as previously described to bring the jaw assemblies 12, 22 toward one another to clamp the workpieces 1, 1*a* together. The arrangement of FIG. 15 allows the clamp to be used with workpieces of virtually any size. In a traditional bar clamp the workpieces must fit between the opposed jaws 12*a* and 22*a* such that the size of the workpieces is limited to the space between the jaw assemblies as determined by the length of the slide bar 14. In the clamp of FIG. 15 virtually any size workpieces may be clamped because the workpieces do not have to fit between the jaw assemblies 12 and 22. While screws 124 are shown that engage apertures in the mounting plates 120, 122 and are screwed into the workpieces 1, 1*a*, the connection method may comprise any mechanism that is able to engage the workpiece without the workpiece having to be positioned between the jaw assemblies such as clamps, magnets or the like. The jaw assemblies 12 and 22 may also include opposed jaws 12*a* and 22*a* such as are found in a traditional bar clamp in addition to the mounting plates 120, 122 where the mounting plates may be mounted to the top of the jaw assemblies 12 and 22 such that the bar clamp may be used to clamp either in a traditional manner or as shown in FIG. 15.

Figure 16:
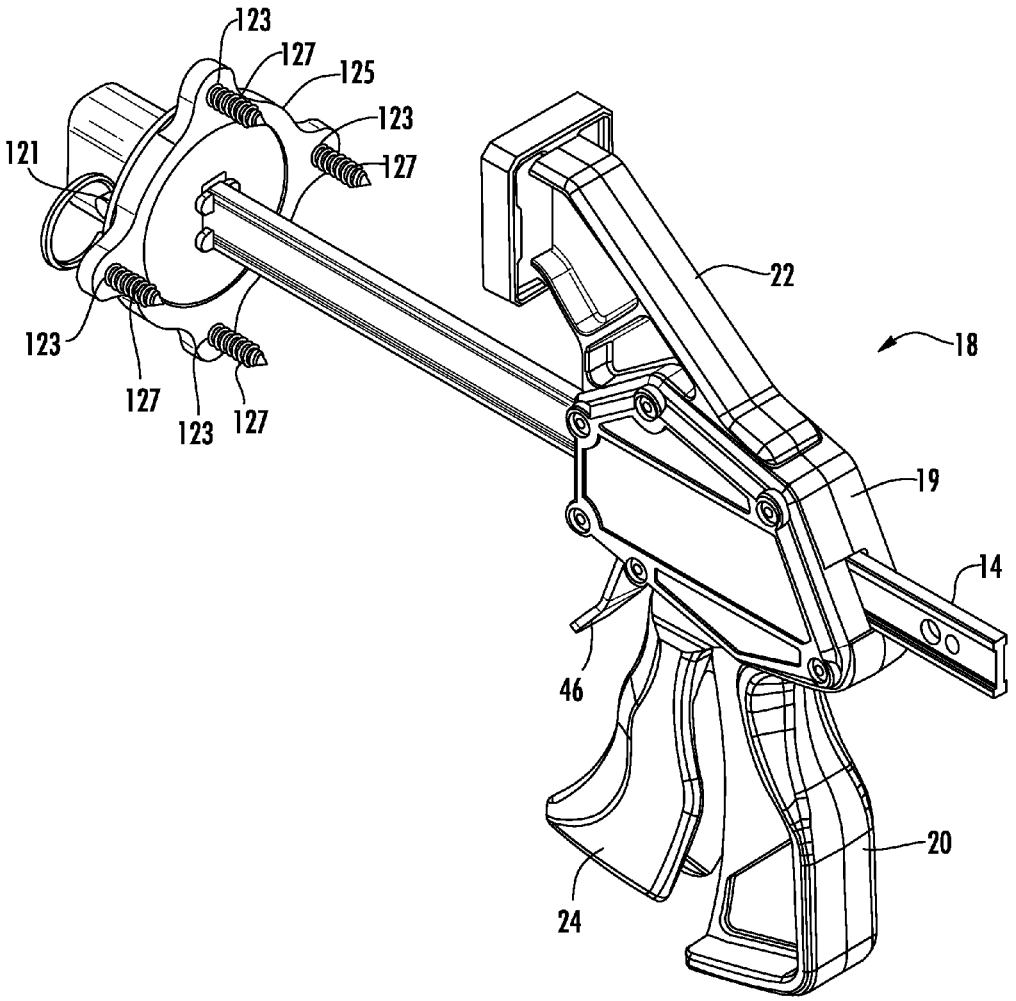
FIG. 16 is a perspective view of another embodiment of a bar clamp of the invention.
Figure 17:
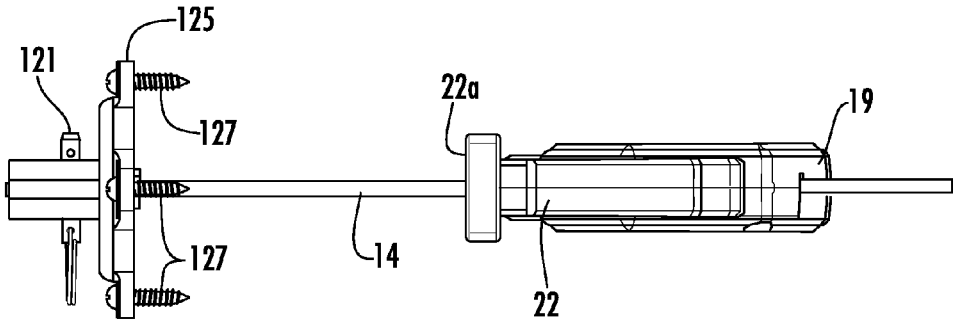
FIG. 17 is a top view of the bar clamp of FIG. 16.
Figure 18:
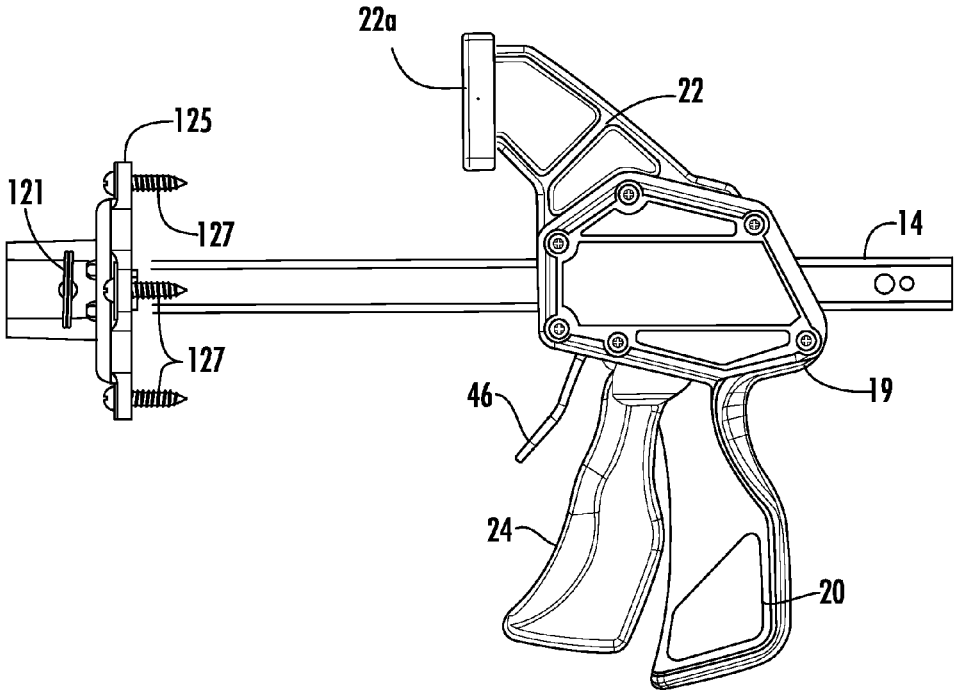
FIG. 18 is a side view of the bar clamp of FIG. 16.

FIGS. 16-18 show a bar clamp where the movable jaw assembly 12 of the traditional bar clamp is replaced by mounting plate 125. The plate 125 is oriented such that a mounting surface 125*a* of the plate 125 is perpendicular to the direction of movement of slide bar 14 and faces the fixed jaw assembly 22. The mounting plate 125 includes apertures 123 that receive screws 127 such that the plate 125 may be secured to a face of a workpiece. The bar clamp operates as previously described to move the plate 125 toward the fixed jaw assembly 22 to clamp a workpiece. The mounting plate 125 may be releasably secured to the slide bar 14 using a housing that fits over the end of the slide bar 14 and holds a removable pin 121 that engages the aperture 57 formed at the end of the slide bar 14. The screws 127 may secure the bar clamp to a workpiece. The screws may also be used to secure the bar clamp to the underside of a worktable or other platform. While screws 127 are shown that engage apertures 123 in the mounting plate 125, other connection methods may be used.

Figure 20:
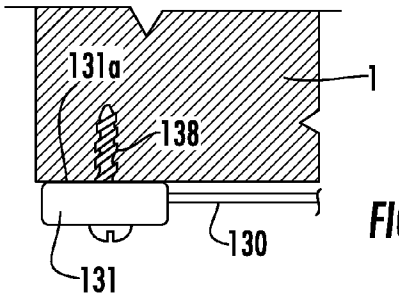
FIG. 20 is a detailed side view of an alternate embodiment of the bar clamp of FIG. 19.
Figure 19:
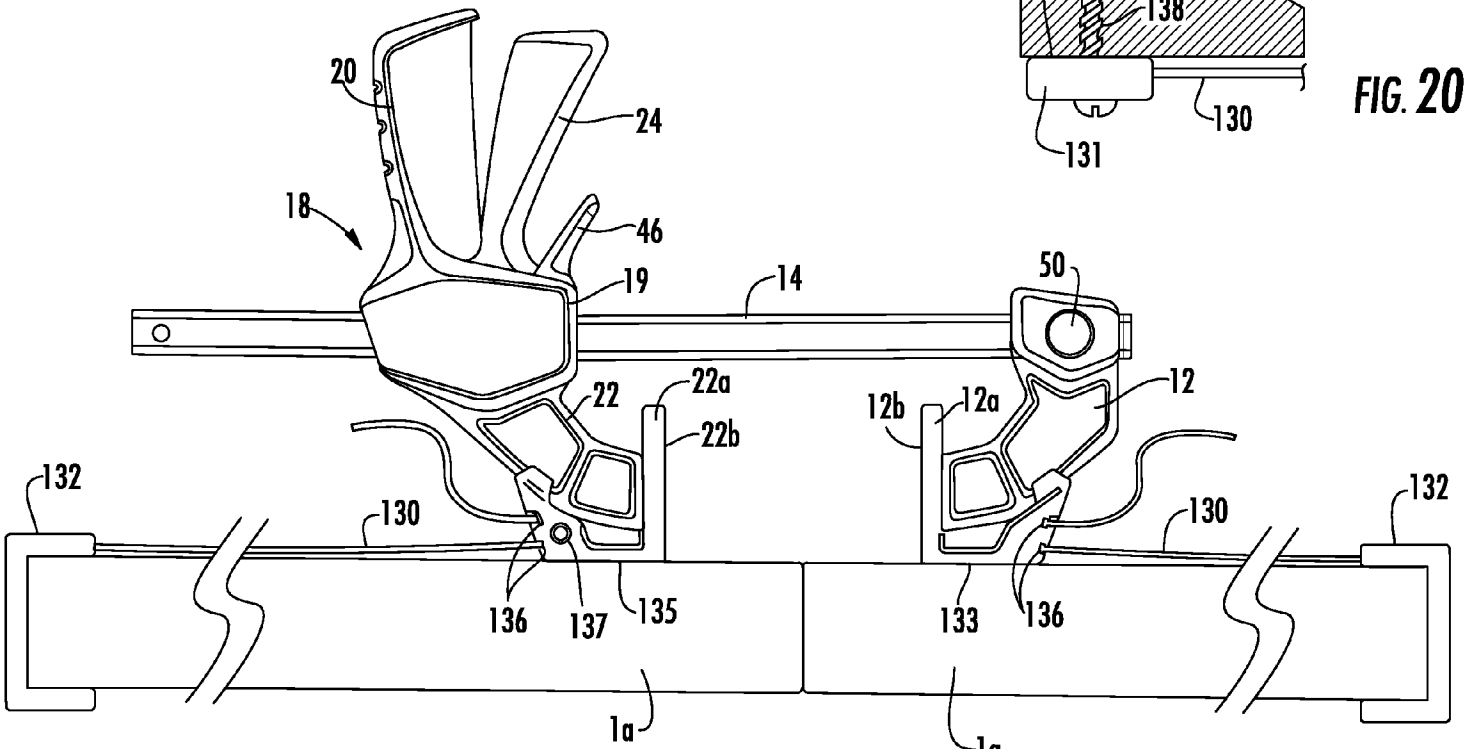
FIG. 19 is a side view of another embodiment of a bar clamp of the invention with clamping workpieces.

FIGS. 19 and 20 show a bar clamp where straps 130 are attached to each of the opposing jaw assemblies 12, 22. The term "straps" may include straps, cords, wires, cables or other relatively strong flexible elongated members. The straps 130 have a mounting structure attached to the distal ends thereof. The effective length of the straps between the jaw assemblies and the mounting structures is adjustable. To adjust the length of the straps 130 apertures 136 may be formed in the jaw assemblies 12 and 22 where the straps 130 may be laced through the apertures 136 and the proximate or distal end of the straps may be pulled to shorten or lengthen the effective length of the straps. A locking mechanism such as a knurled locking member may hold the straps in the desired position and may be released by release button 137. The length of the straps may be adjusted using other adjustment mechanisms such as reels that wind the straps, buckles, a pin on the jaws that engages apertures on the straps or other suitable adjustment mechanisms. In other embodiments the length of the straps may be adjusted away from the jaw assemblies. For example, the straps may comprise adjustable straps such as winch straps, ratchet straps, buckle straps or the like. As shown in FIG. 20 the mounting structure may comprise mounting plates 131 similar to the mounting plates of FIG. 15 where the plates define mounting surfaces 131*a* and are attached to the workpieces using fasteners such as screws 138. In one embodiment the mounting structure may comprise brackets such as C-channel brackets 132 that engage the ends of the workpieces 1, 1*a*. In other embodiments other mounting structures may be used such as brackets having shapes other than the illustrated C-channel, adjustable clamps or the like. In one embodiment the distal ends of the jaw assemblies 12 and 22 are formed with coplanar flat support surfaces 133 and 135 that define a plane disposed outside of the jaw assemblies 12 and 22. The workpieces being clamped may be supported on the support surfaces 133 and 135 to stabilize the workpieces during the clamping operation. As shown, the clamp may rest on the workpieces in an inverted position during use if desired. The bar clamp operates as previously described to bring the jaw assemblies 12 and 22 toward one another. As the jaw assemblies 12 and 22 are moved toward one another the straps 130, which are mounted on the jaw assemblies, pull the workpieces 1, 1*a* toward one another to clamp the workpieces 1,1*a* together. The arrangement of FIGS. 19 and 20 allows the clamp to be used with workpieces of virtually any length. In a traditional bar clamp the workpieces must fit between the opposed jaws such that the size of the workpieces is limited to the space between the jaw assemblies as determined by the length of the slide bar 14. In the clamp of FIGS. 19 and 20 virtually any length workpieces may be clamped because the workpieces do not have to fit between the jaw assemblies 12 and 22. The mounting structure may comprise any mechanism that is able to engage the workpieces without the workpiece having to be positioned between the jaw assemblies. The clamp assemblies 12, 22 may also include opposed jaws 12*a* and 22*a* such as are found in a traditional bar clamp.

Figure 21:
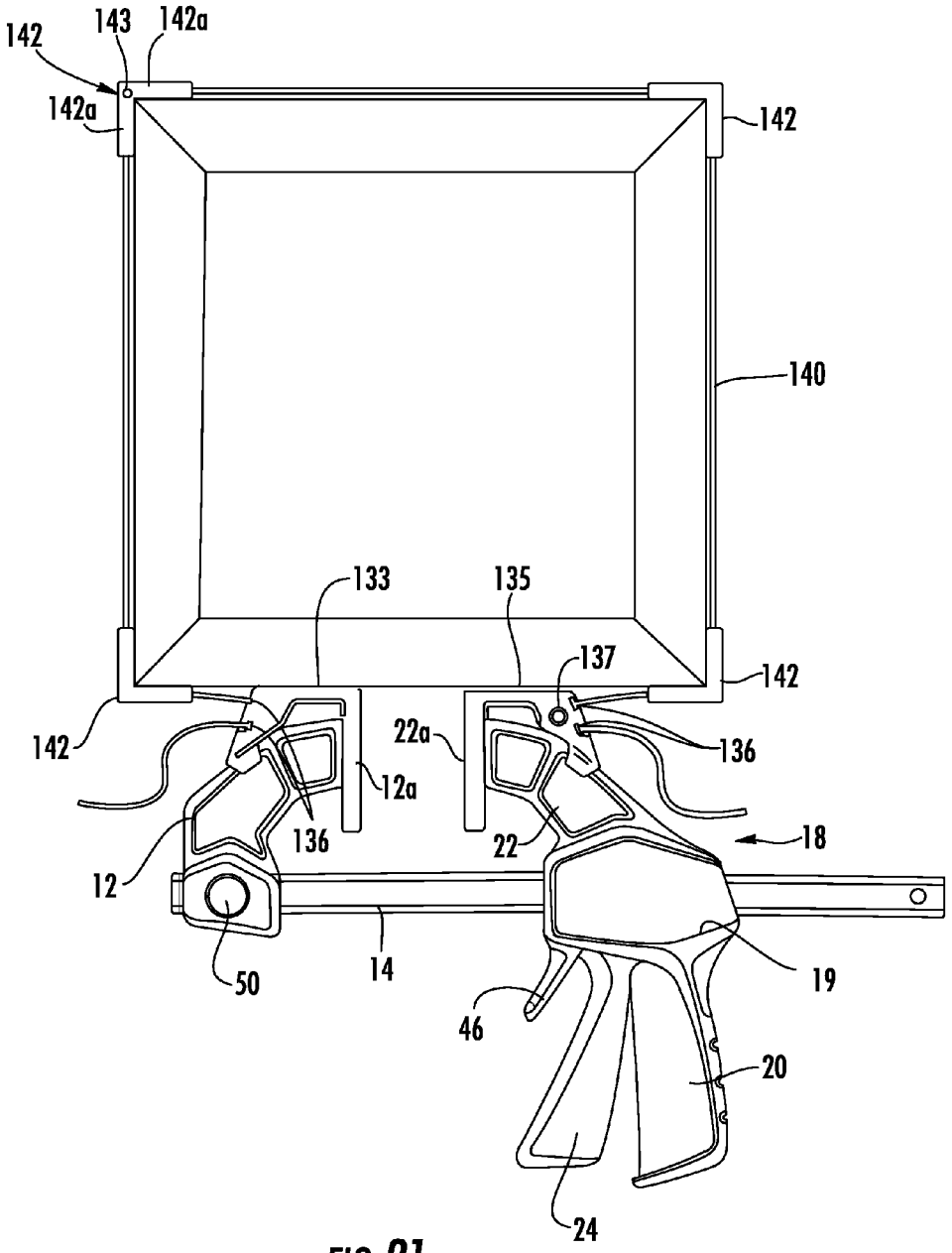
FIG. 21 is a side view of another embodiment of a bar clamp of the invention with clamping workpieces.

FIG. 21 shows a bar clamp where a single strap 140 is attached to both of the opposing jaw assemblies 12 and 22. The strap 140 has an adjustable length and a mounting structure attached thereto. As previously described, to adjust the effective length of the strap 140 between jaw assemblies 12 and 22 apertures 136 may be formed in the jaw assemblies 12 and 22 where the strap 140 may be laced through the apertures 136 and the strap may be pulled to shorten or lengthen the strap. A locking mechanism such as a knurled locking member may hold the strap 140 in the desired position and may be released by release button 137. The length of the strap 140 may be adjusted using other adjust mechanisms such as reels that wind the strap, buckles, a pin on the jaws that engages apertures on the strap or other suitable adjustment mechanisms. In other embodiments the length of the strap 140 may be adjusted away from the jaw assemblies. For example, the strap 140 may comprise an adjustable strap such as winch strap, ratchet strap, buckle strap or the like. The strap 140 has an adjustable length and a corner supports 142 mounted along the length thereof. While four corner supports 142 are shown a greater or fewer number of supports may be used depending on the application. The mounting structure may comprise corner supports 142 that are adjustably mounted on strap 140 such that the corner supports may be mounted at any position along the length of the strap 140. The corner supports 142 engage the corners of the workpiece to clamp the sides of the work piece together. The illustrated clamp is intended to be used with a rectangular workpiece having four corners where each corner support 142 defines a right angle channel. In other embodiments the corner supports may have other shapes and sizes. For example three corner supports may be used each defining a 120 degree channel. Moreover the corner supports may have a universal or adaptable shape where the flanges 142*a* of the corner supports 142 pivot relative to one another at a pivot 143. The bar clamp operates as previously described to bring the jaw assemblies 12 and 22 toward one another. As the jaw assemblies 12 and 22 are moved toward one another the strap 140, which is mounted on the jaw assemblies, surrounds the workpieces and compresses the workpieces to clamp the workpieces together. The arrangement of FIG. 21 allows the clamp to be used with workpieces of virtually any size. The jaw assemblies 12 and 22 may include opposed jaws 12*a* and 22*a* such as are found in a traditional bar clamp. The ends of the jaw assemblies 12 and 22 may be provided with flat support surfaces 133 and 135, respectively, such that the clamp may rest on or abut the workpieces. The mounting structure may comprise mounting plates similar to the mounting plates of FIG. 15 where the plates define mounting surfaces and are attached to the workpieces using fasteners such as screws 138. In other embodiments the mounting structures may be removed and the strap may encircle the workpieces and apply the clamping force directly to the workpieces.

Figure 22:
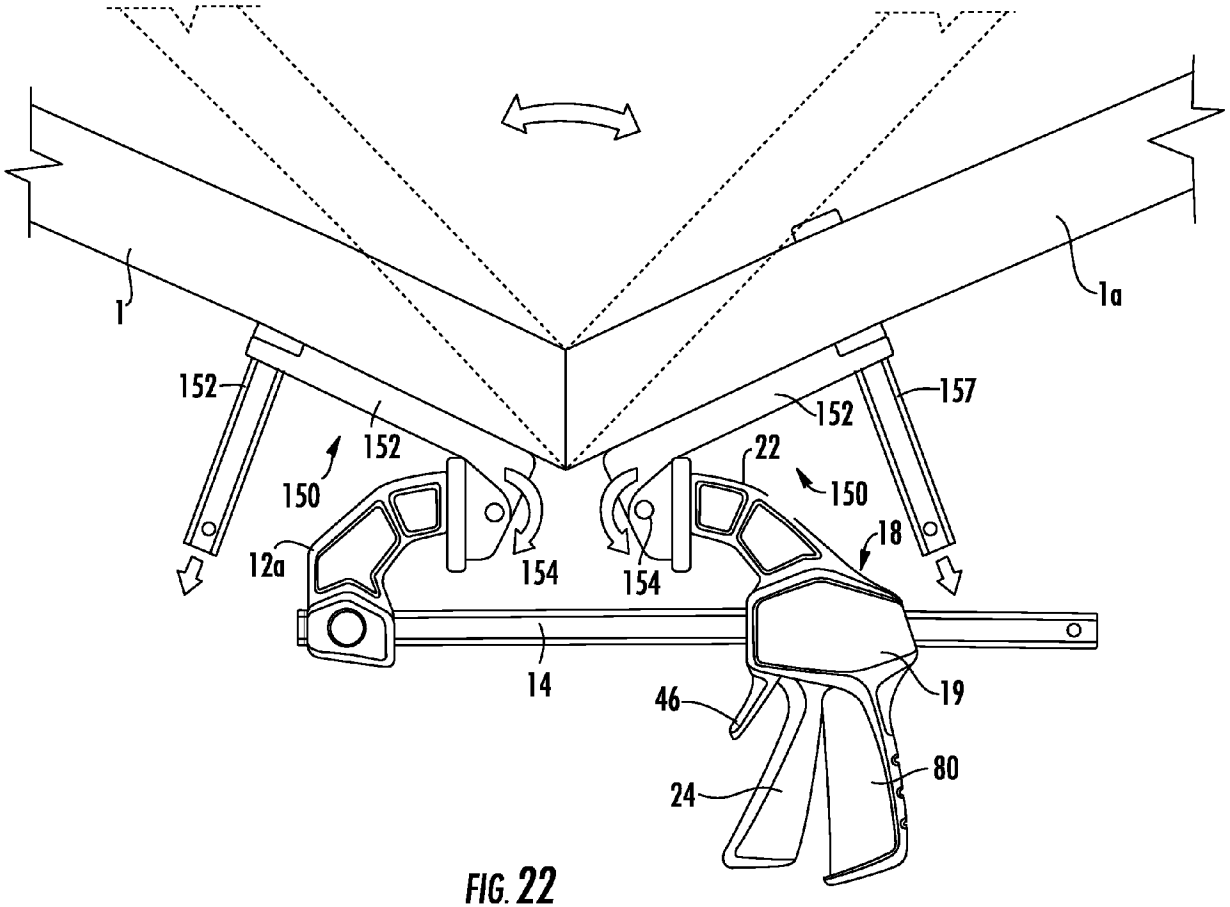
FIG. 22 is a side view of another embodiment of a bar clamp of the invention clamping workpieces.

FIG. 22 shows a bar clamp having adjustable angle brackets 150 mounted to the jaw assemblies 12 and 22. The angle brackets 150 comprise a support member 152 that is mounted to the jaw assemblies such that the support members 152 may rotate relative to the jaw assembly about a pivot axis 154. The pivot axis 154 may be disposed perpendicular to the direction of movement of the slide bar 14 and the support members 152 may be arranged to define a variable angle therebetween. The support members may be locked in position relative to the jaw assemblies by any suitable lock mechanism including a ratcheting mechanism, ball and detent, removable pins or the like. A clamp 157 such as a small bar clamp, screw clamp or other clamp may be mounted on the support member 152 to hold a workpiece on the support member. The bar clamp operates as previously described to bring the jaw assemblies 12 and 22 toward one another. As the jaw assemblies 12 and 22 are moved toward one another, the adjustable angle brackets clamp workpieces 1, 1*a* together at the angle set by the angular position of support members 152.

Figure 24:
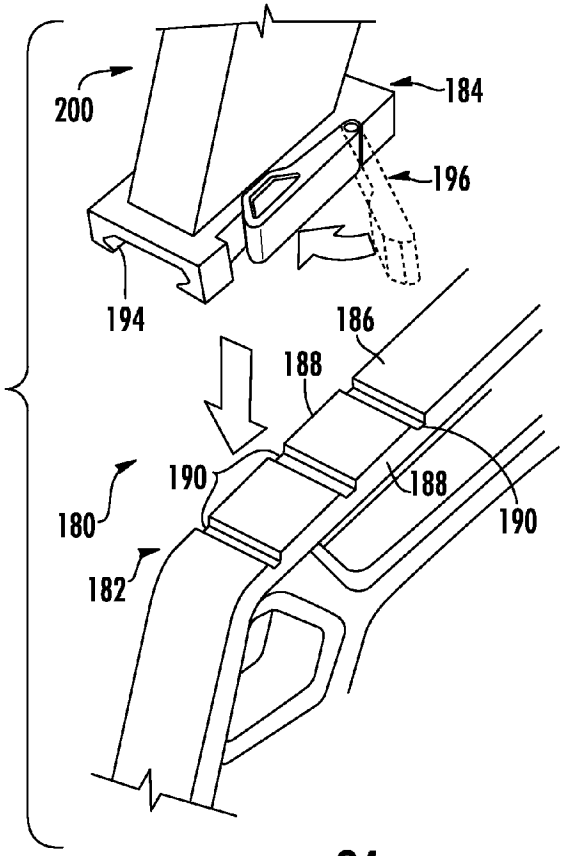
FIG. 24 is a detailed exploded perspective view of the bar clamp of FIG. 23.
Figure 23:
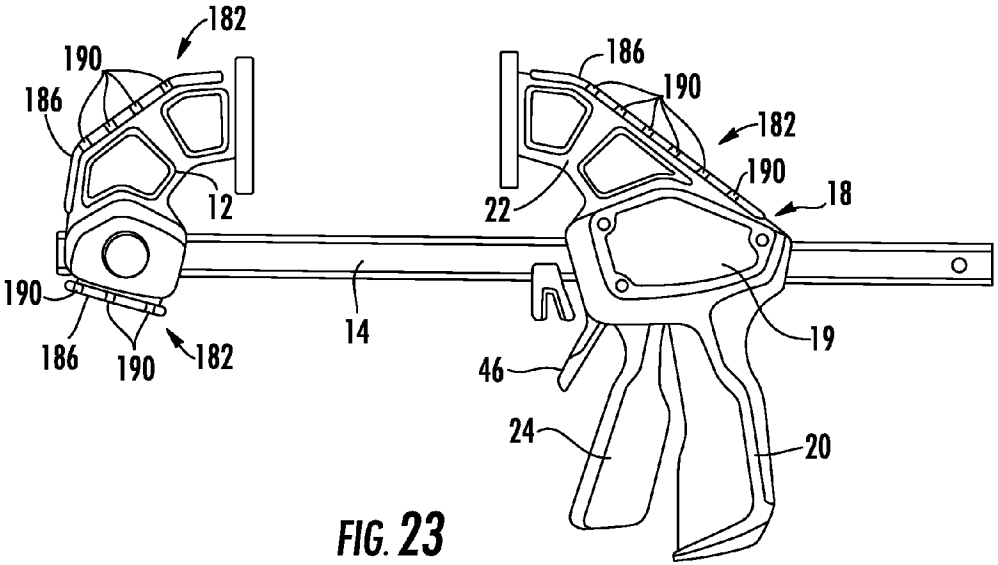
FIG. 23 is a side view of another embodiment of a bar clamp of the invention.

FIGS. 23 and 24 show a bar clamp comprising an accessory mounting system 180 that allows a variety of accessories to be releasably mounted on the bar clamp. In one embodiment, the mounting system 180 comprises a first attachment mechanism 182 mounted on at least one of the movable jaw assembly 12 and/or the fixed jaw assembly 22. In the illustrated embodiment, a first attachment mechanism 182 is mounted on both of the movable jaw assembly 12 and the fixed jaw assembly 22, with two first attachment mechanisms being mounted on the movable jaw assembly 12. The first attachment mechanism 182 may be mounted elsewhere on the bar clamp provided that it doesn't interfere with the operation of the clamp. A second attachment mechanism 184 is provided on an accessory 200 where the second attachment mechanism may releasably engage the first attachment mechanism 182. In one embodiment the first attachment mechanism 182 comprises a rail 186 where the second attachment mechanism 184 may be positionable along the length of the rail 186 such that the position of the accessory 200 on the rail 186 may be adjusted and selected by the user. In one embodiment the attachment system may be similar to a Picatinny rail system or a Weaver rail system. The rail 186 may comprise a pair of extending flanges 188 that create a generally T-shaped rail. The flanges include a plurality of spaced grooves or recesses 190. The attachment mechanism 184 on the accessory 200 comprises a C-shaped channel 194 that fits over the rail 186 such that the channel 194 may slide over the rail 186. A locking mechanism operatively coupled with the channel 194 releasably engages the grooves or recesses 190 to fix the position of the accessory 200 relative to the rail 186. The locking mechanism may comprise a movable lever 196 that moves an engagement structure into engagement with the grooves or recesses 190 when the lever is moved from an unlocked position (dashed line FIG. 24) to a locked position (solid line FIG. 24). The engagement structure may comprise an end of the lever 196 that operatively engages the rail, a movable locking member such as a sprig biased ball, a cam or the like. The locking mechanism may comprise other mechanisms such as bolts, thumbscrews or the like that engage the rail. In other embodiments the components may be reversed where the jaw assembly may comprise a channel and the accessory may comprise a slide that fits into the channel. The mating first attachment mechanism 182 and second attachment mechanism 184 may have a variety of shapes and sizes that allow the accessory to be movably mounted on the bar clamp.

Figure 25:
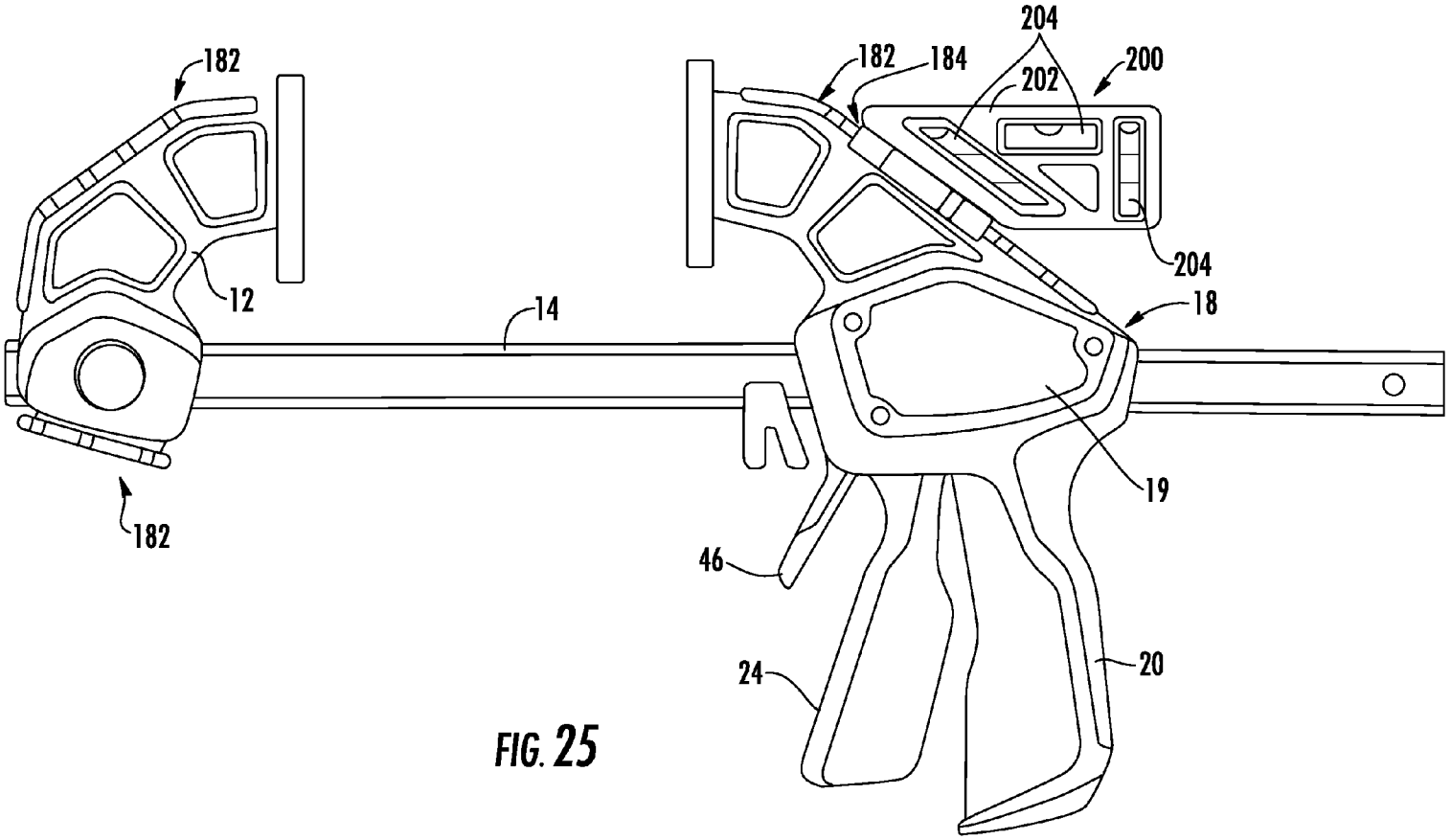
FIG. 25 is a side view of the bar clamp of FIG. 23 with a first accessory.

FIG. 25 shows an embodiment of the accessory mounting system where the accessory 200 comprises a level 202. The level 202 may comprise a plurality of bubble vials 204. The bubble vials may be arranged to read horizontal, vertical and 45 degrees. As used herein the terms "horizontal, vertical and 45 degrees" mean parallel to the slide bar, perpendicular to the slide bar and at a 45 degree angle relative to the slide bar. The bubble vials may be replaced by an electronic level device.

Figure 26:
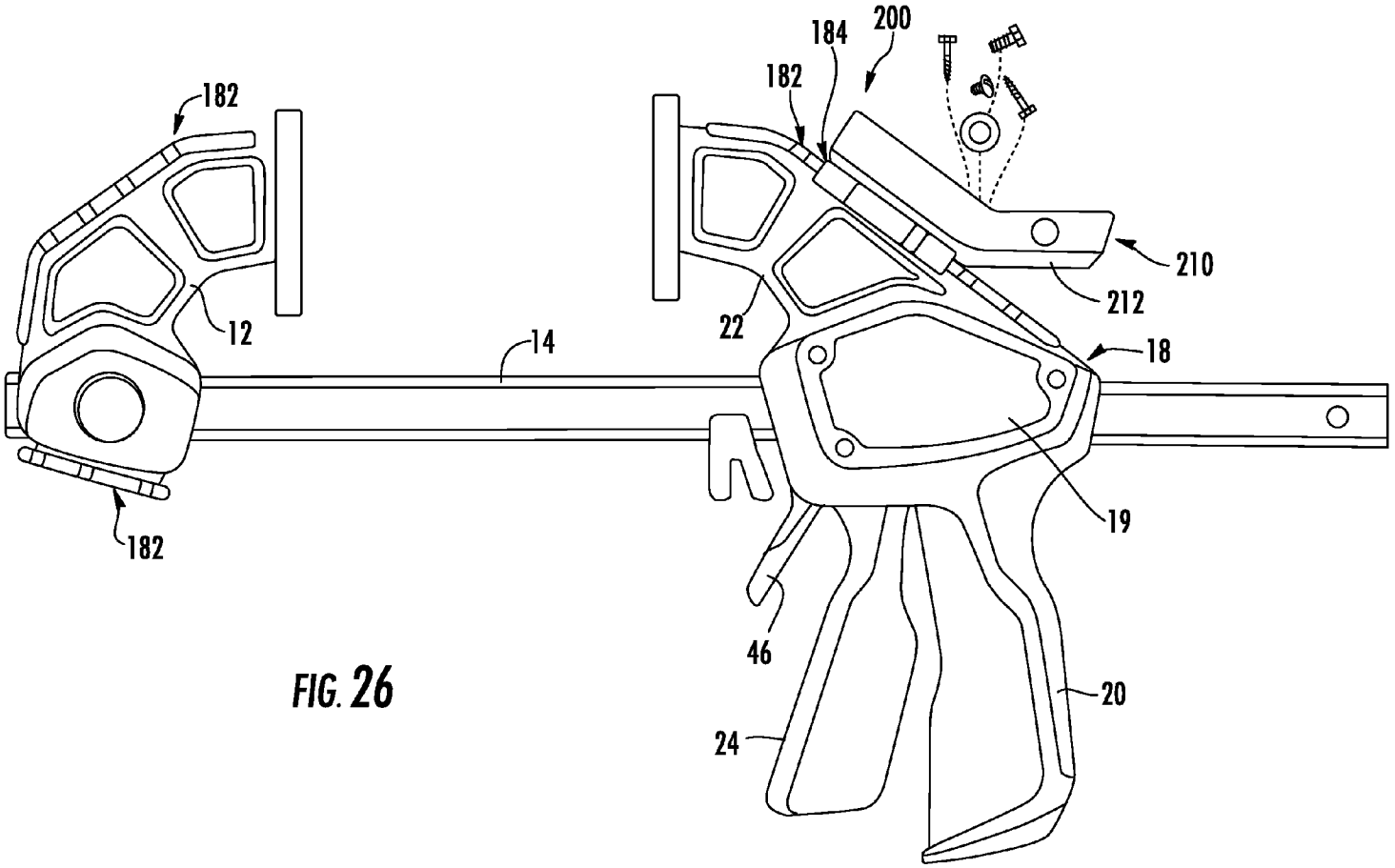
FIG. 26 is a side view of the bar clamp of FIG. 23 with a second accessory.

FIG. 26 shows an embodiment of the accessory mounting system where the accessory 200 comprises a storage device 210 such as a container, tray or case for retaining small items such as screws, nails, bolts, small tools or the like. The storage device 210 may comprise a magnetic tray 212. In other embodiments the container may be a covered case or a specialized storage device such as a drill bit holder, tool holder or the like.

Figure 27:
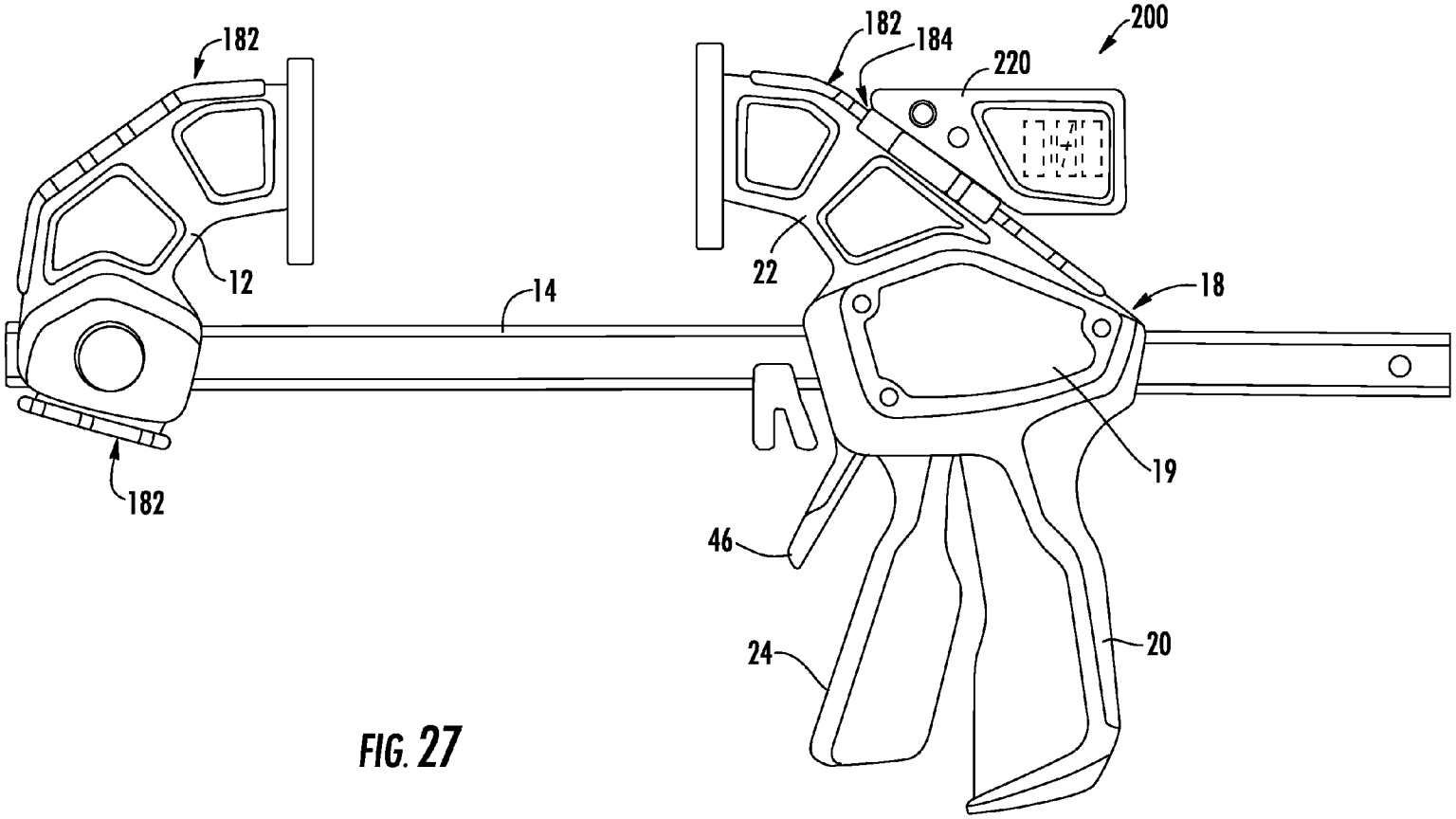
FIG. 27 is a side view of the bar clamp of FIG. 23 with a third accessory.

FIG. 27 shows an embodiment of the accessory mounting system where the accessory 200 comprises a timer 220. The timer may be used, for example, to time curing time for adhesives or the like. In this and in other embodiments of the invention the various accessories may be combined in a single unit. For example, a single accessory may comprise the timer 220 and level 202.

Figure 28:
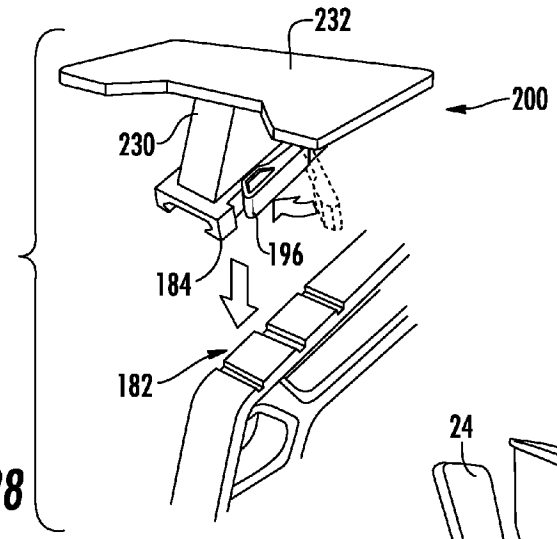
FIG. 28 is an exploded perspective view of the bar clamp of FIG. 23 with a fourth accessory.
Figure 30:
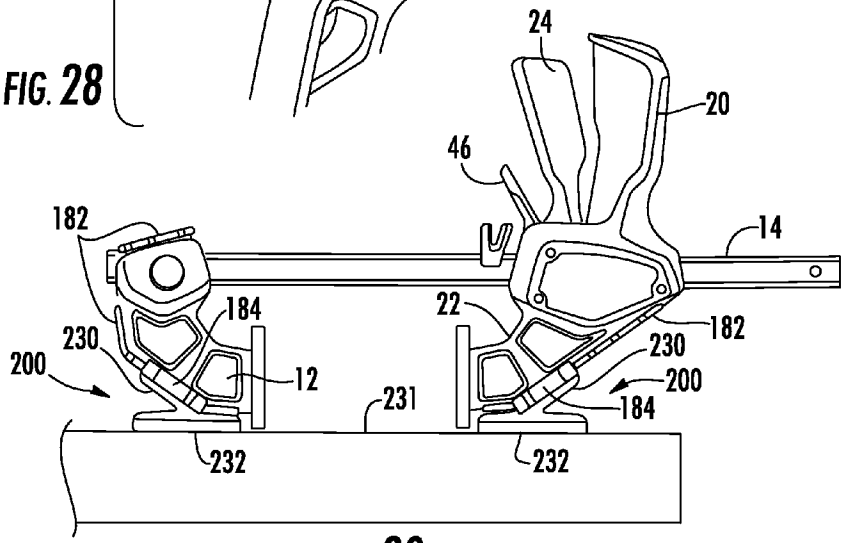
FIG. 30 is a side view of the bar clamp of FIG. 23 with the fourth accessory in a second orientation.
Figure 29:
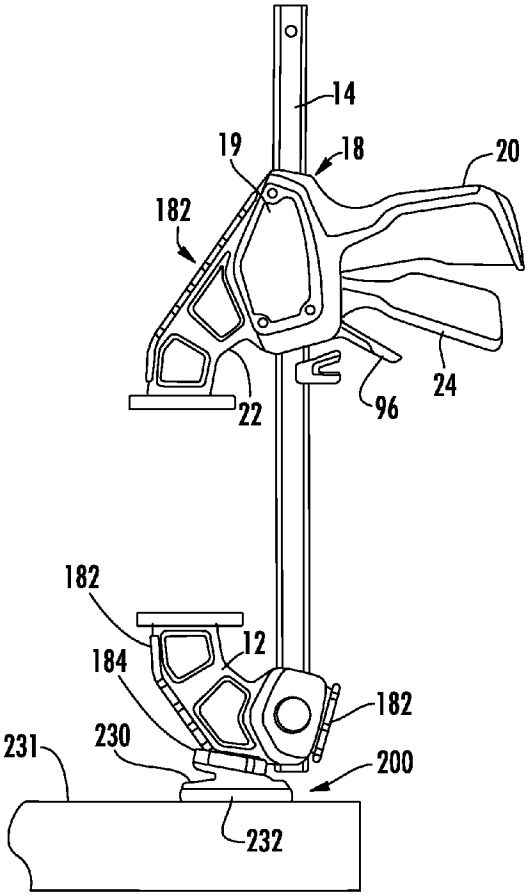
FIG. 29 is a side view of the bar clamp of FIG. 23 with the fourth accessory.

FIG. 28 shows an embodiment of the accessory mounting system where the accessory 200 comprises a stand 230. The stand 230 may comprise a support surface 232 that is dimensioned to support the bar clamp in an upright position on a surface. In one embodiment the support surface 232 may comprise a flat surface as shown. In other embodiments the support surface 232 may comprise legs such as a tripod, a clamp or the like. The support surface 232 may be disposed at an angle relative to the second attachment mechanism 184 such that when the stand 230 is mounted on the rail 186 the support surface 232 may be supported on a surface 231 where the clamp is disposed at a desired upright orientation such as vertical, horizontal or other angle. In the embodiment shown in FIG. 30, a stand 230 is provided on both the fixed jaw assembly 22 and the movable jaw assembly 12 where the support surfaces 232 of the stands are coplanar and operate together to support the clamp in an upright position.

In addition to the accessories shown in the drawings, the accessories may comprise other devices. For example, the accessories may comprise a small clamp, a note pad, a white board, a rag holder, a light such as an LED light, a cell phone holder, a welding splatter guard or the like.

FIGS. 31-36 show a bar clamp comprising removable jaw attachments. In the embodiments of FIGS. 31-36 the jaw attachments comprise pads 238. The jaw assemblies 12 and 22 comprise an attachment mechanism for releasably attaching a variety of pads to the jaw assemblies. In one embodiment the attachment system comprises a first attachment mechanism 242 mounted on the jaw assemblies 12, 22. A second attachment mechanism 244 is provided on the pads 238 where the second attachment mechanism 244 may releasably engage the first attachment mechanism 242. In one embodiment the first attachment mechanism 242 may comprise a generally T-shaped jaw member 246 comprising a pair of extending flanges 250. The attachment mechanism 244 on the pads comprises channels 252 that fit over the member 246 such that the pads may be slid onto the member 246. A locking mechanism may be provided to temporarily fix the pads 238 to the jaw members 246. For example the pads 238 may be secured to the jaw members 246 using a friction fit, snap-fit connector, separate fasteners such as screws, a ball and detent or the like. The pads 238 may comprise a variety of different types or styles of pads including different shapes and sizes, materials or the like. As illustrated the pads may be relatively larger, smaller, taller, shorter, wider or narrower. The pads may comprise a rigid member 254 that includes the second attachment mechanism 244. The rigid member 254 may be covered by a cover 256 that may comprise an elastomer or other specialized surface. The surfaces may be different for different types of the pads. FIG. 31 shows pads that are dimensioned to conform in area to the size of the jaw members 246 of the jaw assemblies. FIG. 32 shows pads that are relatively wider than the jaw members 246. FIG. 33 shows pads that are relatively taller than the jaw members 246.

Figure 34:
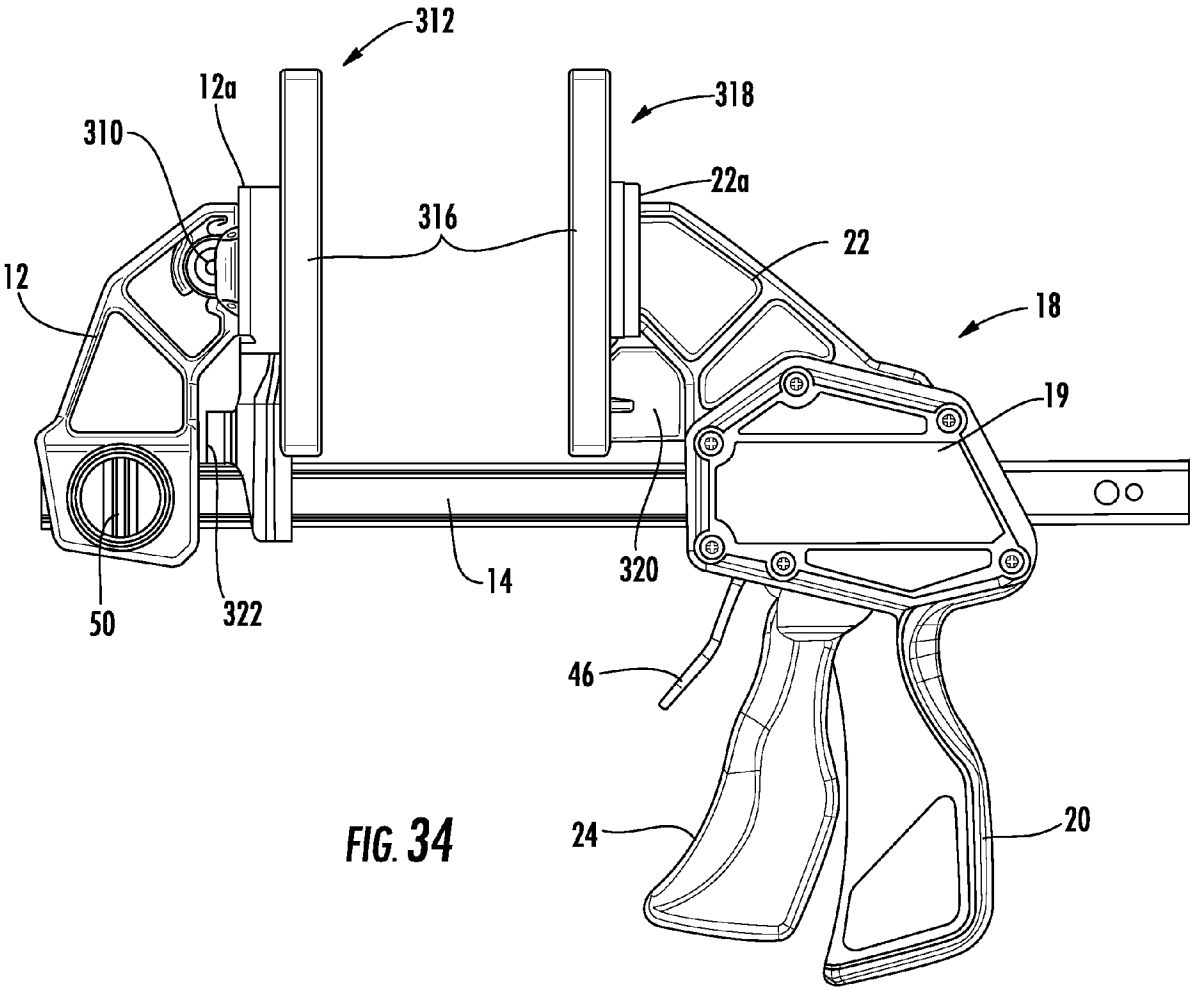
FIG. 34 is a side view of another embodiment of a bar clamp with a fourth jaw attachment.
Figure 35:
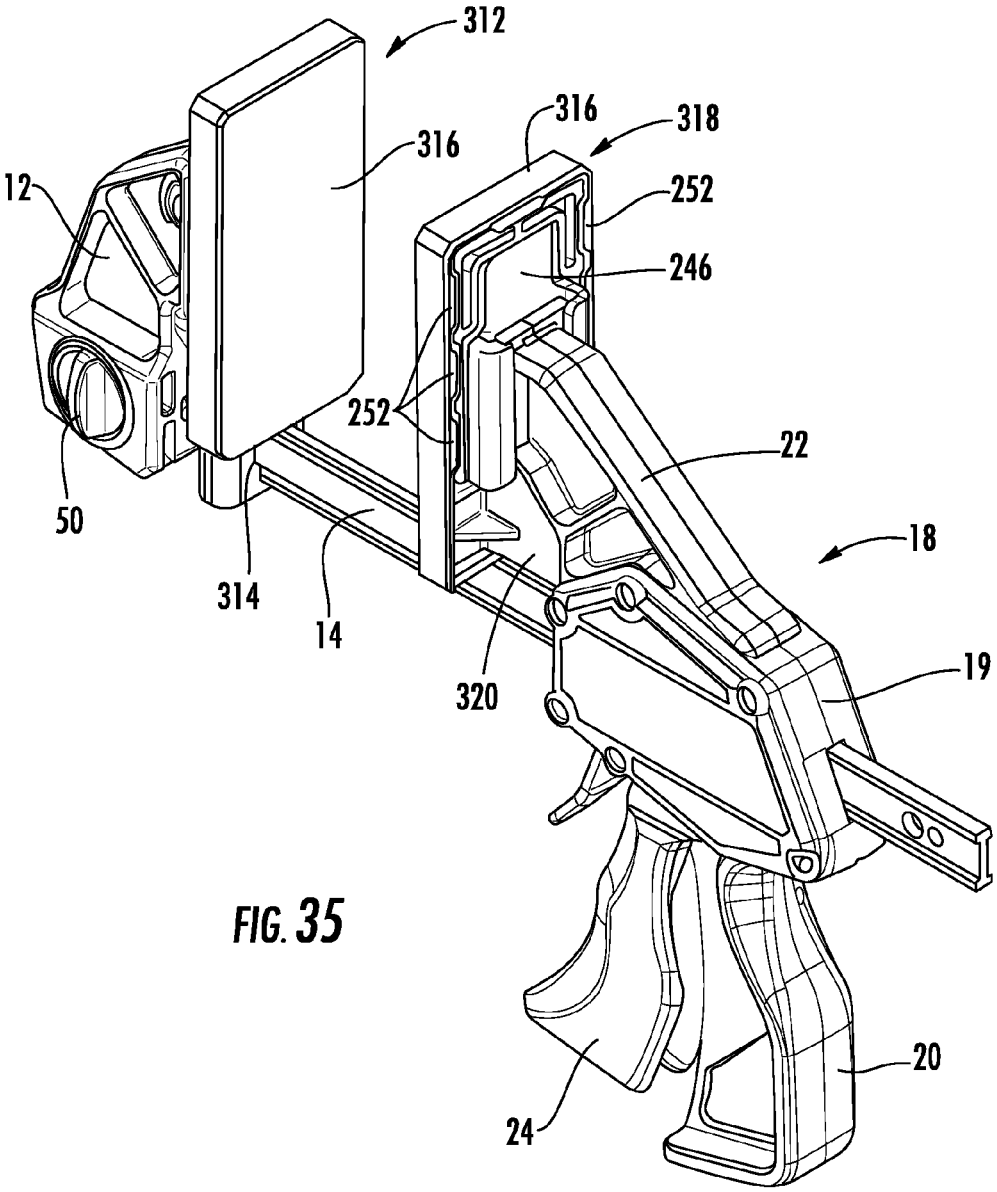
FIG. 35 is a perspective view of the bar clamp of FIG. 34.
Figure 36:
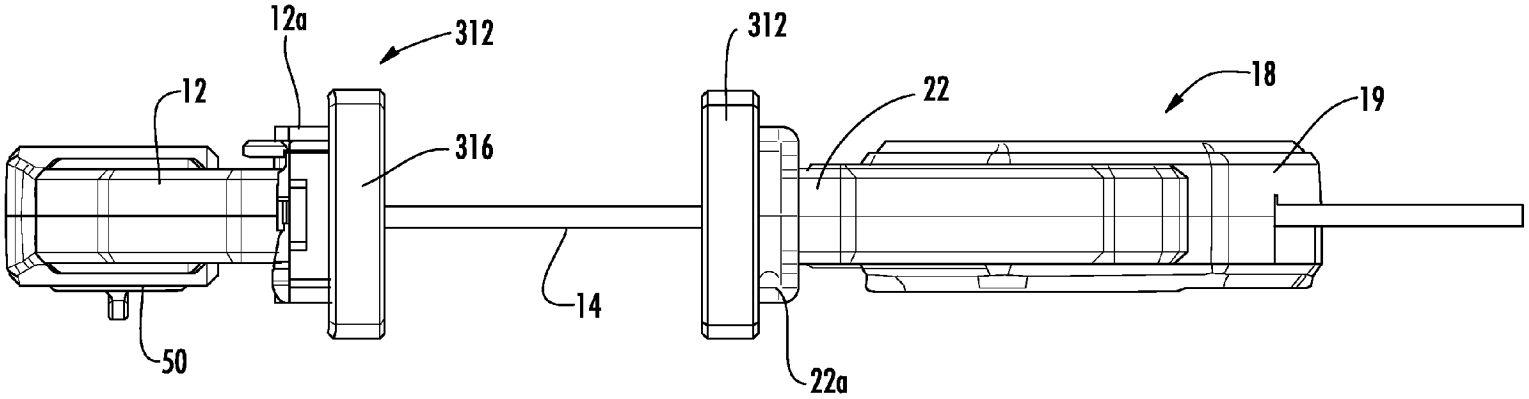
FIG. 36 is a top view of the bar clamp of FIG. 34.
Figure 37:
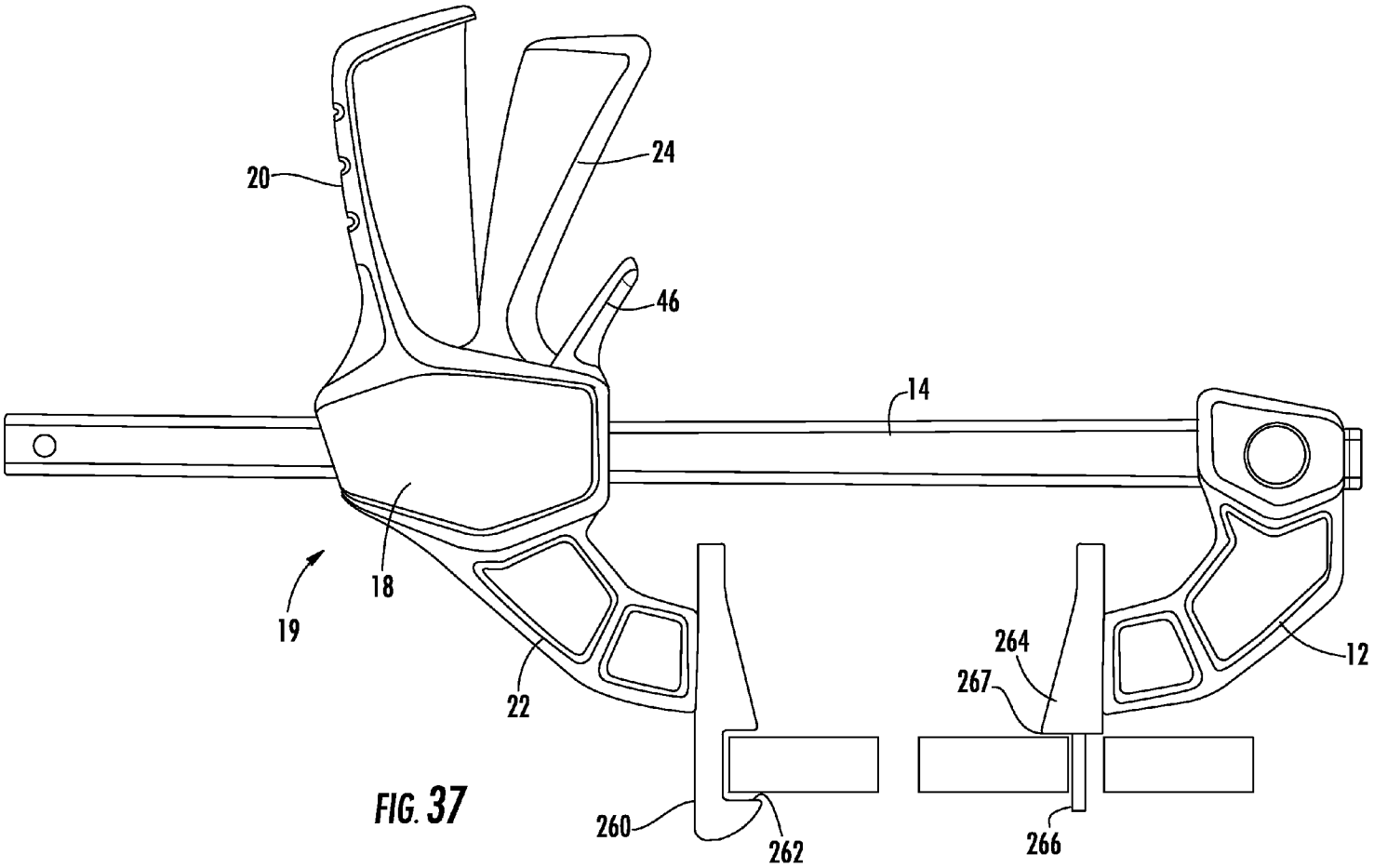
FIG. 37 is a side view of another embodiment of a bar clamp of the invention with clamping workpieces.

In the embodiment of FIGS. 34-36 the jaw 12*a* is pivotably mounted to the jaw assembly 12 at pivot 310. The jaw attachment 312, that is mounted to the movable jaw assembly 12, extends to the slide bar 14 and includes an aperture 314 for receiving the slide bar 14 to prevent the jaw attachment 312 from pivoting about pivot 310 during a clamping operation. The movable jaw assembly 12 may be removed from the bar 14, the jaw attachment 312 may be attached to the jaw 12*a* and the slide bar 14 may be inserted through the aperture 314 of the jaw attachment 312 and mounted to the movable jaw assembly 12. A screw 50 that engages the aperture at the end of the slide bar 14 may be used to removably mount the jaw assembly 12 to the slide bar 14. The jaw attachment 318, that is mounted to the fixed jaw assembly 22, extends to just above the slide bar 14. A spacer 320 may extend from the jaw attachment 318 that abuts the jaw assembly 22 to maintain the attachment 318 in a vertical position if a clamping force is applied to the bottom of the attachment 318. A similar spacer 322 may extend from the jaw attachment 312 that abuts the jaw assembly 12 to maintain the attachment 312 in a vertical position if a clamping force is applied to the bottom of the attachment 312. The jaw 12*a* may be secured to the jaw attachment 312 and the jaw 22*a* may be attached to the jaw attachment 318 using the mating attachment mechanisms 242 and 244 as described with respect to FIG. 31. As shown in FIGS. 34-36 jaw pad 316 supported on jaw attachment 312 and 318 extends from adjacent the slide bar 14 to beyond the distal end of the jaw assemblies to provide a relatively large clamping face.

FIGS. 37-44 disclose embodiments of jaw attachments that may be used for specialized functions. In the embodiments of FIGS. 37-44 the jaw attachments may be removably mounted on the jaw assemblies in the same manner as the pads of FIGS. 31-36 such that a single bar clamp may be modified for different specialized uses. In other embodiments the jaw attachments may be permanently part of the jaw assemblies such that the clamp is dedicated to a specialized use.

Figure 38:
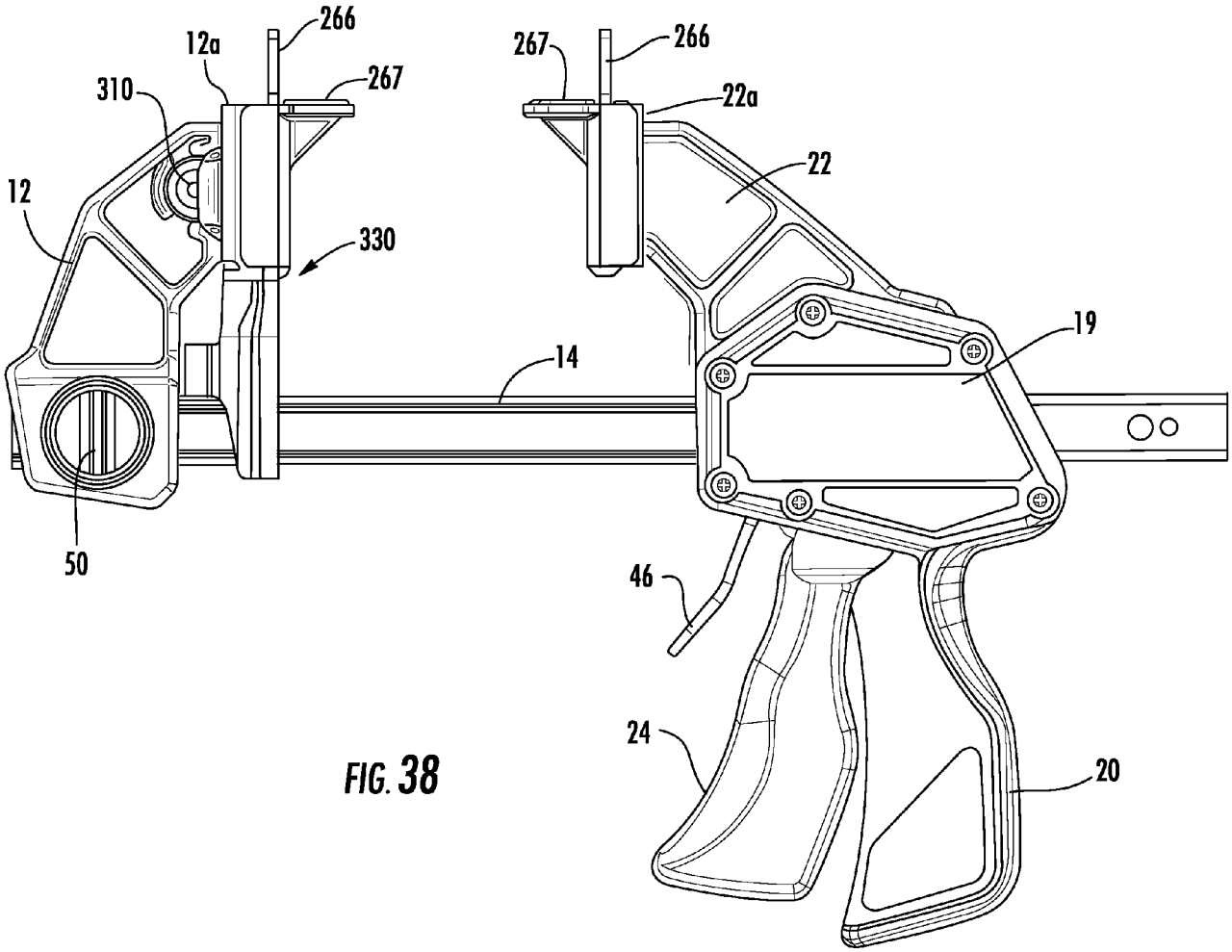
FIG. 38 is a side view of another embodiment of a bar clamp of the invention.
Figure 39:
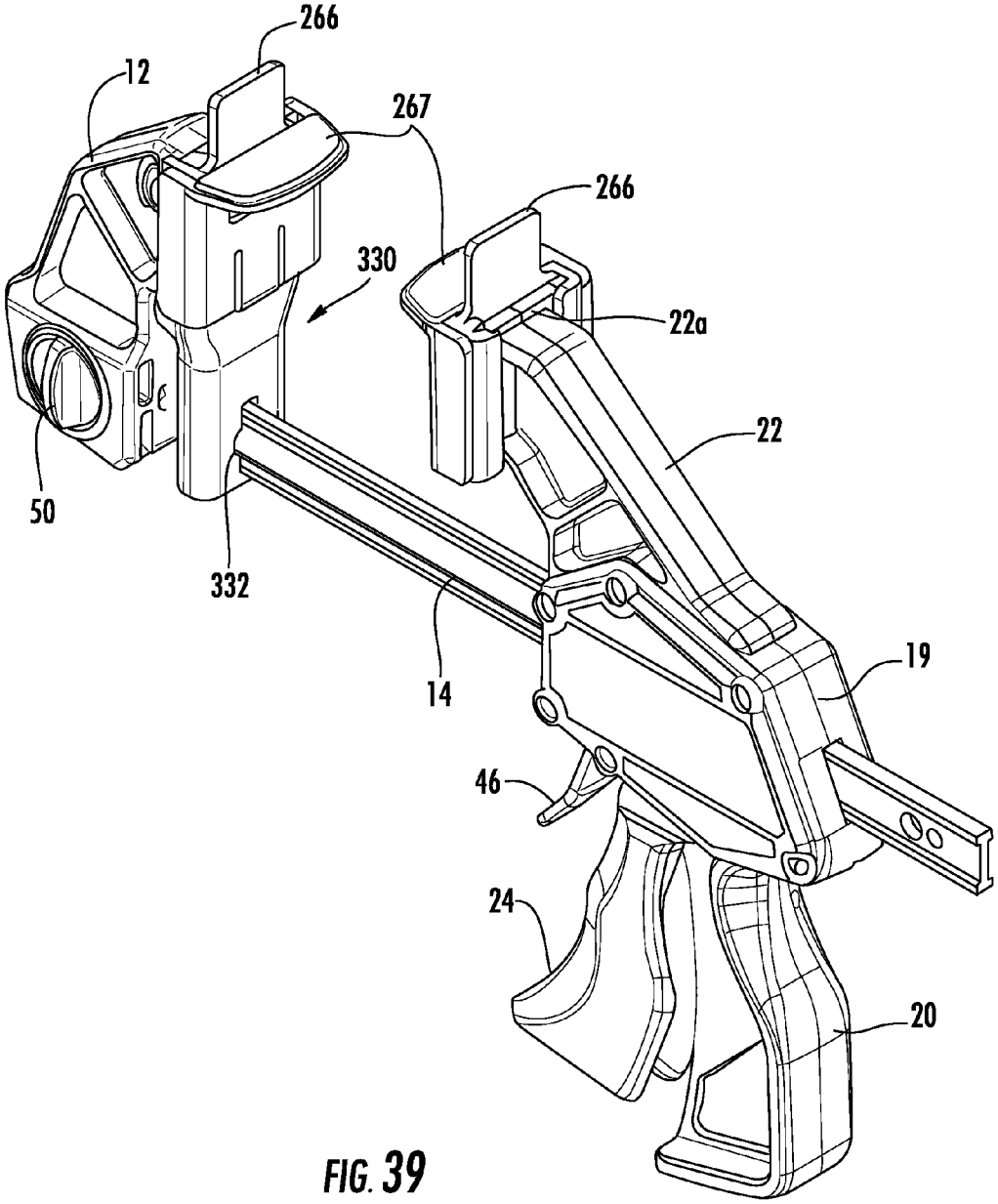
FIG. 39 is a perspective view of the bar clamp of FIG. 38.
Figure 40:
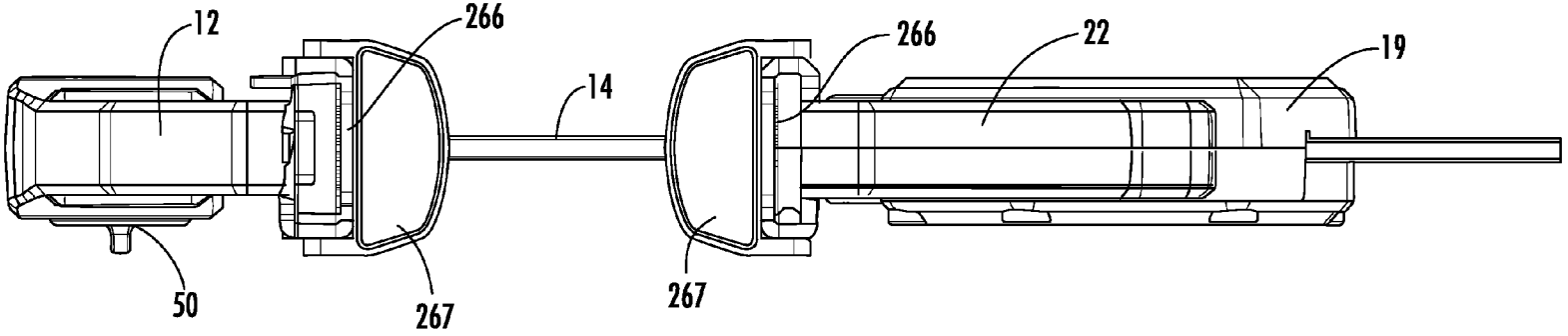
FIG. 40 is a top view of the bar clamp of FIG. 38.

FIGS. 37-40 show jaw attachments that may be used for decking. The jaw attachments may include a first jaw attachment 260 having a C-channel 262 for engaging a deck board and a second jaw attachment 264 that includes a planar member 266 that extends perpendicularly to the slide bar and that may engage a side of the board and may fit between adjacent boards. FIGS. 38-40 disclose a similar decking clamp where both jaw attachments include planar clamping members 266 that extend perpendicularly to the slide bar and that may fit between adjacent deck boards. The jaw attachments may be formed with stop surfaces 267 that are perpendicular to the plannar member 266 that operate to abut the deck boards to stabilize the clamp in an inverted position. In the embodiment of FIGS. 38-40, the jaw attachment is pivotably mounted to the jaw assembly 12 at pivot 310. The jaw attachment 330 mounted to the movable jaw assembly 12 may extend to the slide bar 14 and include an aperture 332 for receiving the slide bar 14 to prevent the jaw attachment from pivoting about pivot 310 during a decking operation. The movable jaw assembly 12 may be removed from the slide bar 14, the jaw attachment 330 may be attached to the jaw assembly and the slide bar 14 may be inserted through the aperture 332 in the jaw attachment and mounted to the movable jaw assembly. A screw 50 that engages the aperture at the end of the slide bar may be used to removably mount the jaw to the slide bar.

Figure 41:
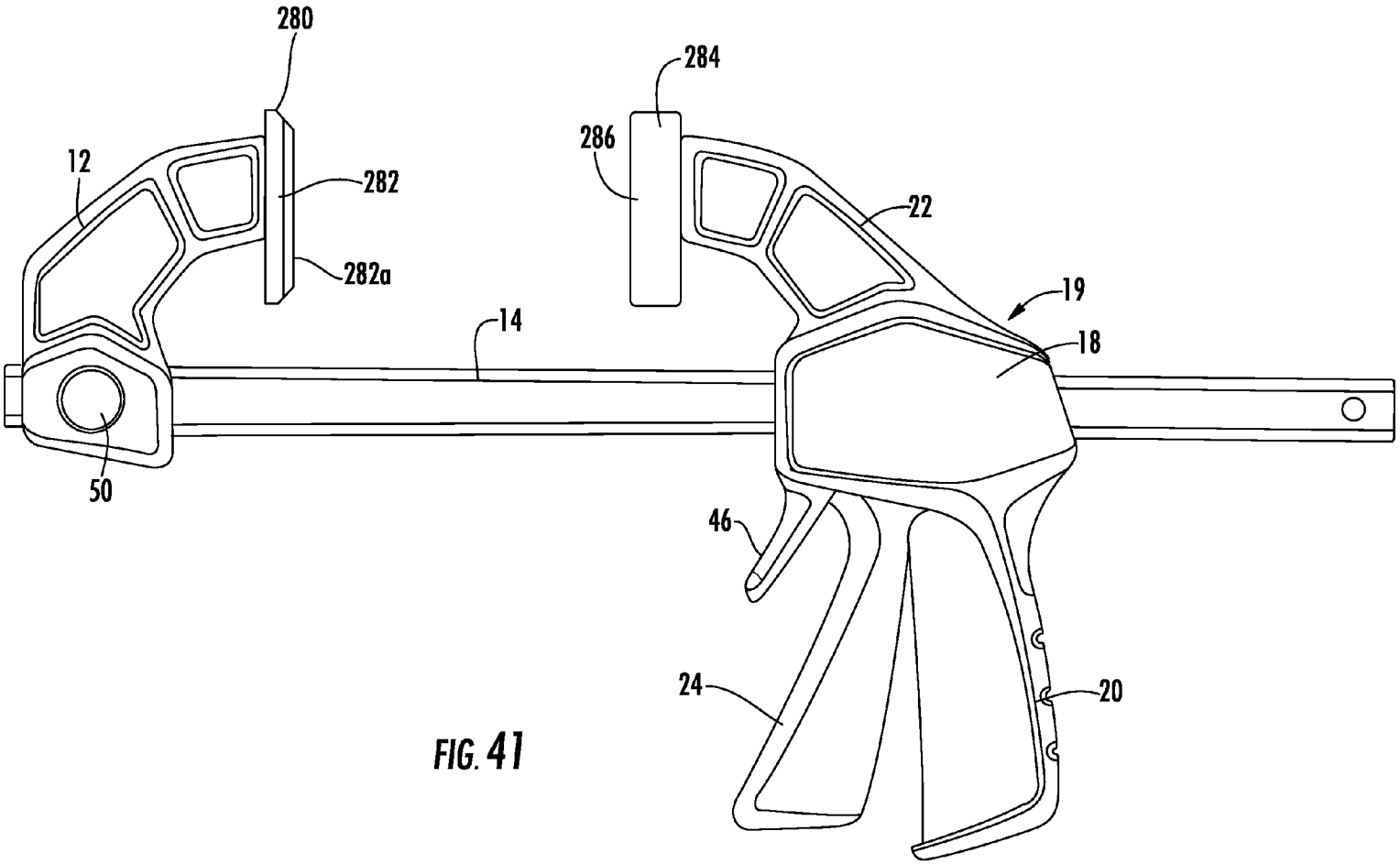
FIG. 41 is a side view of another embodiment of a bar clamp of the invention.

FIG. 41 discloses an embodiment of a jaw attachment that may be used for splitting wood. The jaw attachments may include a first attachment 280 having a rigid blade 282 for engaging a board. The blade 282 defines a relatively sharp edge 282*a* and a second attachment 284 that includes a planar member 286 that may engage the opposite end of the board. The blade may be formed as a wedge such as a chisel or mawl edge. A board may be secured between the jaw attachments such that as the jaws are brought toward one another upon actuation of the trigger 24 the blade 282 splits the wood.

Figure 42:
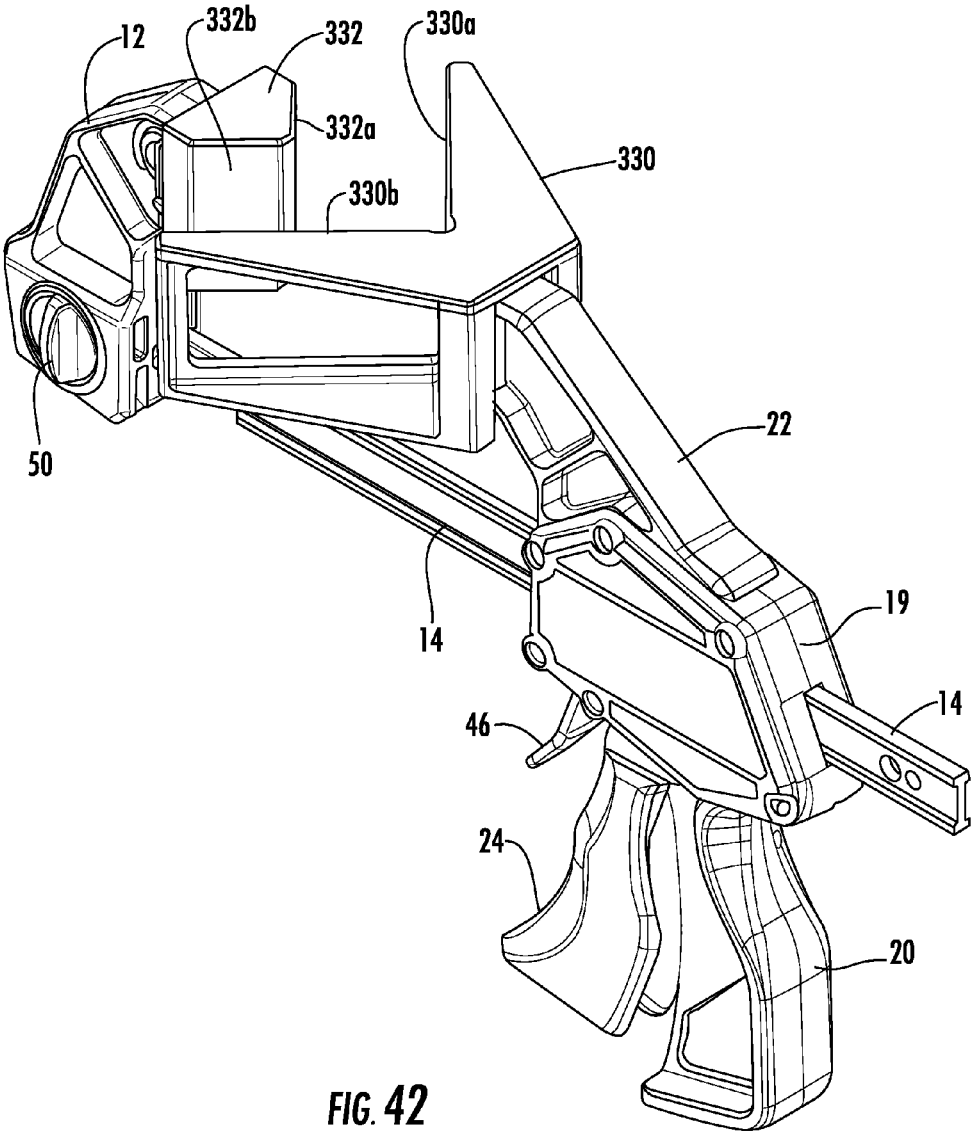
FIG. 42 is a perspective view of another embodiment of a bar clamp of the invention.
Figure 43:
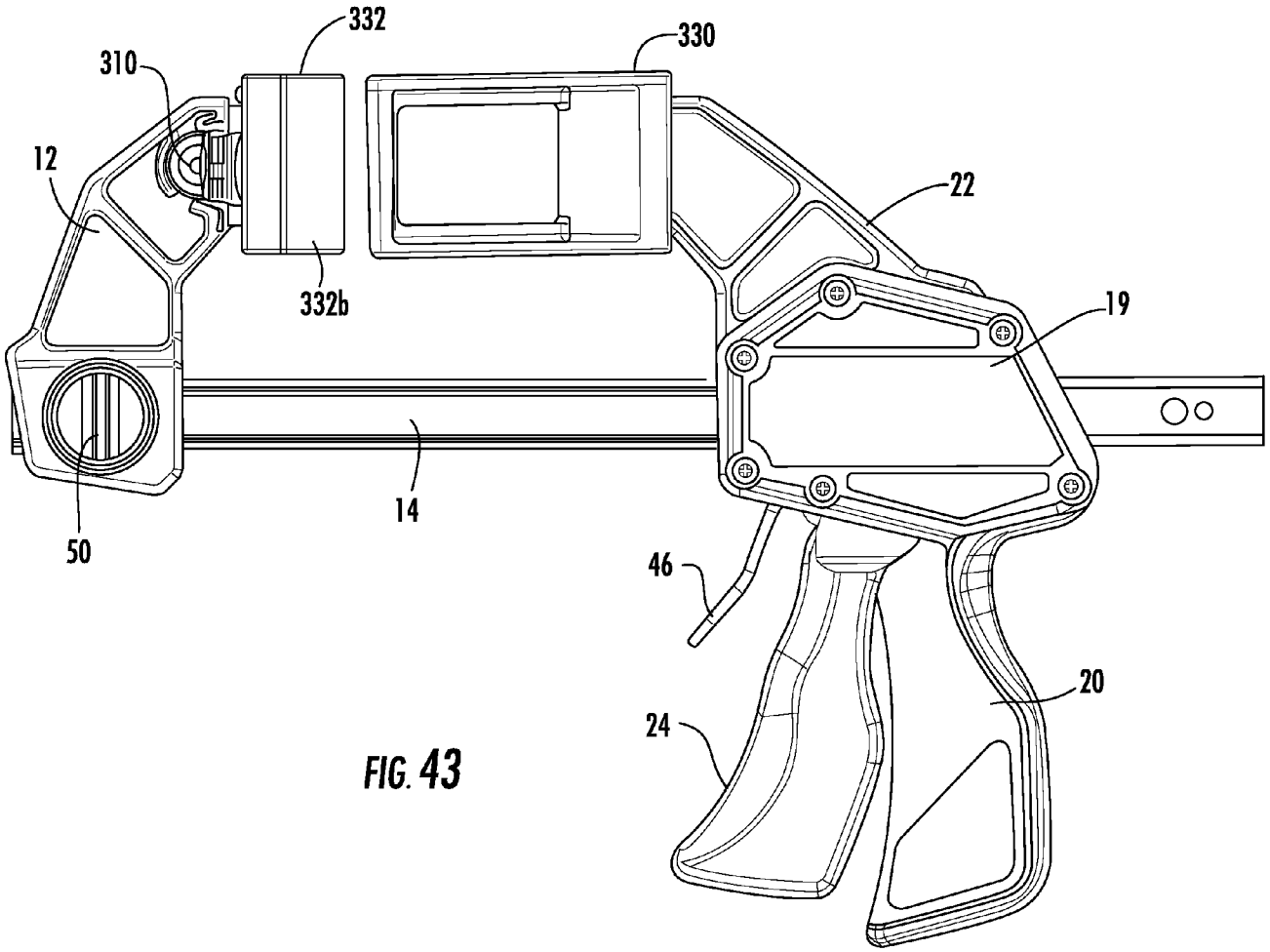
FIG. 43 is a side view of the bar clamp of FIG. 42.
Figure 44:
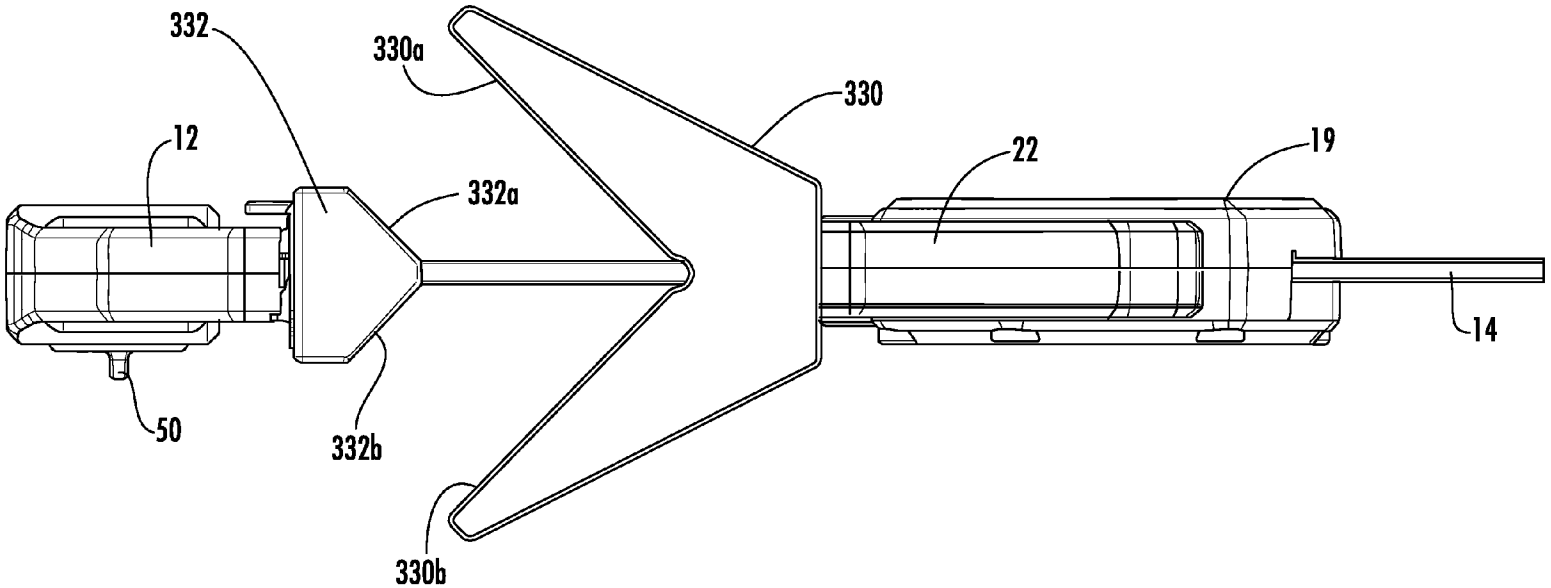
FIG. 44 is a top view of the bar clamp of FIG. 42.

FIGS. 42-44 show a bar clamp comprising corner jaw attachments. The corner jaws comprise a first jaw 330 having jaw faces 330*a* and 330*b* defining an external corner support for engaging the external corner of a workpiece and a second jaw 332 having jaw faces 332*a* and 332*b* defining an internal corner support that may engage the internal corner of the work piece. The jaw faces extend generally transverse to the slide bar 14 such that the corners between the faces are disposed vertically; however, the faces may be arranged such that the corners are disposed horizontally if desired. The jaw attachments may be relatively rigid members and the jaw faces may be covered in elastomeric pads. The jaw faces 330*a*, 330*b* and 332*a*, 332*b* are arranged at 90 degrees in the illustrated embodiment although other angular relationships may be used. Because the jaw attachments are removable, the jaw assemblies 12 and 22 may each support an internal corner support 332 or each may support an external corner support 330.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A bar clamp comprising:

a first slide bar supporting a movable jaw assembly and comprising a first aperture;

a second slide bar supported in a fixed jaw assembly and comprising a second aperture, the fixed jaw assembly including a drive mechanism for moving the second slide bar relative to the fixed jaw assembly;

a connector releasably engaging the first aperture of the first slide bar and the second aperture of the second slide bar to connect the first slide bar to the second slide bar.

2. The bar clamp of claim 1 wherein the connector comprises:

a third aperture and a fourth aperture;

a first movable pin extending through the first aperture of the first slide bar and the third aperture of the connector; and a second movable pin extending through the second aperture of the second slide bar and the fourth aperture of the connector.

3. The bar clamp of claim 1 wherein the connector comprises at least one slot for receiving a first end of the first slide bar and a first end of the second slide bar.

4. The bar clamp of claim 1 wherein the connector comprises a first movable pin engageable with the first aperture and a second movable pin engageable with the second aperture.

5. A bar clamp comprising:

a slide bar supporting a movable jaw assembly, the slide bar supported in a fixed jaw assembly, the fixed jaw assembly including a drive mechanism for moving the slide bar relative to the fixed jaw assembly;

an edge clamp mounted on the slide bar between the fixed jaw assembly and the movable jaw assembly the edge clamp comprising:

a body comprising a slot extending through the body, wherein the slide bar extends through the slot;

a movable jaw disposed along a first side of the body and movable in a second direction transverse to the first direction of movement of the slide bar; and a handle operatively coupled to the movable jaw and disposed along a second side of the body opposite the first side.

6. The bar clamp of claim 5 wherein the edge clamp is movably mounted on the slide bar.

7. The bar clamp of claim 6 wherein the edge clamp comprises a screw clamp where a screw is threadably engaged with the body and comprises a first end coupled to the handle and a distal second end coupled to the movable jaw.

8. A bar clamp comprising:

a slide bar supporting a movable jaw assembly, the slide bar supported in a fixed jaw assembly, the fixed jaw assembly including a drive mechanism for moving the slide bar relative to the fixed jaw assembly; and an accessory mounting system for releasably mounting a plurality of accessories to the bar clamp, wherein the plurality of accessories comprises at least one of a level, a storage device, a timer, or a stand.

9. The bar clamp of claim 8 comprising a first attachment mechanism mounted on at least one of the movable jaw assembly and the stationary jaw assembly such that the position of at least one of the plurality of accessories on the rail is adjustable.

10. The bar clamp of claim 9 wherein each accessory of the plurality of accessories comprises a second attachment mechanism mounted on the accessory.

11. The bar clamp of claim 10 wherein the first attachment mechanism comprises one of a rail and a channel movable on the rail and the second attachment mechanism comprises the other one of a rail and a channel movable on the rail.

12. The bar clamp of claim 11 further comprising a locking mechanism to fix the position of the accessory relative to the rail.

13. A bar clamp comprising:

a slide bar supporting a movable jaw assembly comprising a first jaw member, the slide bar supported in a fixed jaw assembly, the fixed jaw assembly including a second jaw member and a drive mechanism for moving the slide bar relative to the fixed jaw assembly in a first direction; and removable jaw attachments comprising a first removable jaw attachment slidably coupled to the first jaw member and a second removable jaw attachment slidably coupled to the second jaw member, wherein the removable jaw attachments comprise a wood splitter blade slidably coupled to one of the first jaw member and the second jaw member and a support slidably coupled to the other one of the first jaw member and the second jaw member.

* * * * *